US006915092B2

(12) United States Patent
Yamaguchi et al.

(10) Patent No.: US 6,915,092 B2
(45) Date of Patent: Jul. 5, 2005

(54) PROCESS CARTRIDGE REMANUFACTURING METHOD

(75) Inventors: Koji Yamaguchi, Numazu (JP); Tomonori Mori, Numazu (JP); Yasufumi Yoshino, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 47 days.

(21) Appl. No.: 10/669,054

(22) Filed: Sep. 24, 2003

(65) Prior Publication Data

US 2004/0105698 A1 Jun. 3, 2004

(30) Foreign Application Priority Data

Sep. 30, 2002 (JP) ..... 2002-286051

(51) Int. Cl.[7] ..... G03G 15/00
(52) U.S. Cl. ..... 399/109; 399/111
(58) Field of Search ..... 399/98, 102, 106, 399/107, 109, 111, 113, 114

(56) References Cited

U.S. PATENT DOCUMENTS

| | | | | |
|---|---|---|---|---|
| 6,118,958 A | * | 9/2000 | Nagashima | 399/105 |
| 6,131,011 A | | 10/2000 | Kojima et al. | 399/351 |
| 6,157,792 A | | 12/2000 | Mori et al. | 399/24 |
| 6,266,503 B1 | | 7/2001 | Murayama et al. | 399/117 |
| 6,298,217 B1 | | 10/2001 | Murayama et al. | 399/358 |
| 6,314,266 B1 | | 11/2001 | Murayama et al. | 399/353 |
| 6,404,996 B1 | | 6/2002 | Mori et al. | 399/24 |
| 6,615,008 B2 | * | 9/2003 | Higeta et al. | 399/109 |
| 2002/0110386 A1 | | 8/2002 | Kanno et al. | 399/111 |
| 2003/0086723 A1 | | 5/2003 | Yamaguchi et al. | 399/119 |

FOREIGN PATENT DOCUMENTS

| | | |
|---|---|---|
| JP | 7-140866 | 6/1995 |

* cited by examiner

*Primary Examiner*—Hoan Tran
(74) *Attorney, Agent, or Firm*—Fitzpatrick, Cella, Harper & Scinto

(57) ABSTRACT

A remanufacturing method for remanufacturing a process cartridge includes (i) a pin removing step of removing a pin which connects a transfer member unit and a drum unit; (ii) a drum unit removing step; (iii) a one-end cover removing step of removing an end cover from one longitudinal end of the transfer member unit; (iv) a screw unit removing step of removing a screw unit, disposed in a removed developer accommodating portion, provided in the transfer member unit; (v) a developer removing step of removing the developer accommodated in the removed developer accommodating portion through the opening of the screw unit; (vi) a screw unit mounting step of inserting a screw into the removed developer accommodating portion through the opening of the screw unit, and mounting the screw unit to a transfer member unit frame; (vii) a one-end cover mounting step of mounting the one-end cover to the transfer member unit; and (viii) a coupling step of coupling the transfer member unit and the drum unit by pins.

6 Claims, 20 Drawing Sheets

PROCESS CARTRIDGE REMANUFACTURING METHOD

FIELD OF THE INVENTION AND RELATED ART

The present invention relates to a method for remanufacturing a process cartridge. Here, a process cartridge means a cartridge in which a charging means, a cleaning means, and an electrophotographic photoconductive member are integrally disposed, and which is removably mountable in the main assembly of an electrophotographic image forming apparatus.

An electrophotographic image forming apparatus includes electrophotographic copying machines, electrophotographic printers (LED printers, laser beam printers, etc.), electrophotographic facsimileing machines, electrophotographic wordprocessors, etc.

In the field of an electrophotographic image forming apparatus which employs an electrophotographic image formation process, a cartridge system, that is, a system in which a single or plurality of processing means which act on an electrophotographic photoconductive member are integrally disposed in a cartridge removably mountable in the main assembly of an electrophotographic image forming apparatus, has been employed. A cartridge system allows a user to maintain an image forming apparatus without relying on a service person, drastically improving an image forming apparatus in terms of operational efficiency. Thus, a process cartridge system has been widely used in the field of an electrophotographic image forming apparatus.

A process cartridge such as the above described one uses developer to form an image on recording medium. In other words, an image formation process consumes developer. Thus, as the amount of the developer in a process cartridge is reduced by consumption to an amount too small for forming images satisfactory to a user who purchased the process cartridge, the process cartridge loses its commercial value.

Thus, there have been known various methods for remanufacturing a process cartridge. One of such methods is disclosed in Japanese Laid-open Patent Application 7-140866.

The process cartridge manufacturing disclosed in this patent includes a process for suctioning out the toner in the toner bin of a process cartridge, through the opening for allowing the toner removed from a photoconductive drum by a cleaning blade, to enter the toner bin.

SUMMARY OF THE INVENTION

There has been desired a simple method for remanufacturing a process cartridge, which has lost its commercial value due to the consumption of the developer therein, into a commercially viable process cartridge.

The primary object of the present invention is to provide a simple method for remanufacturing a process cartridge.

Another object of the present invention is to provide a method for remanufacturing a process cartridge, the amount of the developer in which has been reduced by consumption to a level at, or below, which it is impossible to form images satisfactory to a user, into a commercially viable process cartridge.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS (Embodiment 1)

Hereinafter, the preferred embodiments of the present invention will be described in detail with reference to the appended drawings. In the following descriptions of the embodiments, the "front side" of the image forming apparatus means the upstream side of the apparatus in terms of the direction in which recording medium is conveyed from the transfer process to the fixation process (right-hand side in FIG. 1). The "left or right side" of the main assembly of the image forming apparatus, or those of the process cartridge, means the left or right side thereof as seen from the front side of the apparatus. The "lengthwise direction" means the direction parallel to the surface of the recording medium and intersectional (virtually perpendicular) to the direction in which the recording medium is conveyed. The referential numbers in the following descriptions are for referring to drawings, and are not intended to limit in structure the items to which they are assigned.

Figure 1:
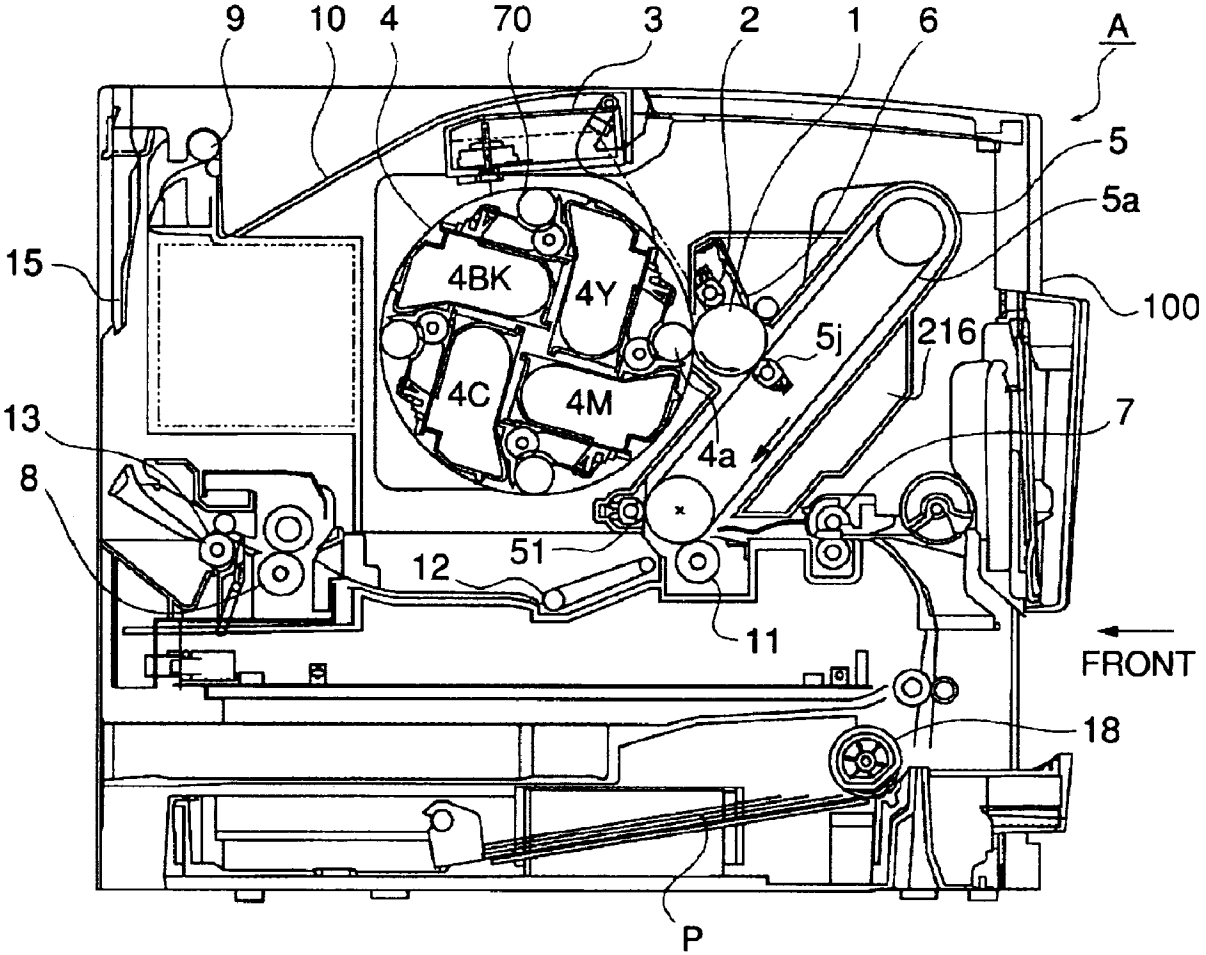
FIG. 1 is a vertical sectional view of an electrophotographic color image forming apparatus, at a plane parallel to the lateral walls of the electrophotographic image forming apparatus.

First, referring to FIG. 1, the general structure of the color image forming apparatus in this embodiment, and the image forming operation thereof, will be described. FIG. 1 is a vertical sectional view of an image forming apparatus in accordance with the present invention, which in this embodiment is an electrophotographic full-color laser beam printer employing four developers different in color, for showing the general structure thereof.

As shown in FIG. 1, the color image forming apparatus A in this embodiment comprises: an electrophotographic photoconductive drum 1; an exposing means 3 which projects an optical image in accordance with image formation information, onto the photoconductive member 1; and a developing apparatus 4 having a plurality of developing devices which are for developing an electrostatic latent image on the photoconductive member 1, and are different in the color in which they develop the electrostatic latent image. It also comprises an intermediary transferring apparatus having: a transfer belt 5*a* onto which the developer images different in color are temporarily transferred; and a transfer roller, as the secondary transferring means, for transferring the developer images on the transfer belt 5*a*, onto a recording medium P, for example, a piece of recording paper, OHP sheet, fabric, etc. Further, it comprises: a fixing apparatus 8 having a pressure roller and a heat roller; a conveying means for conveying the recording medium P to the transferring apparatus 5 and fixing apparatus 8, in the listed order, and then, discharging it from the image forming apparatus; etc.

Next, the details of the image formation process of the color image forming apparatus A will be described.

The photoconductive member 1 is rotated in the direction (counterclockwise direction) indicated by an arrow mark in FIG. 1, in synchronism with the rotation of the transfer belt 5*a*. As the photoconductive member 1 is rotated, the peripheral surface of the photoconductive member 1 is uniformly charged by a charging apparatus 2. Then, the uniformly charged portion of the peripheral surface of the photoconductive drum 1 is exposed to a beam of light projected, while being modulated with the image formation information regarding, for example, yellow component of an intended image, from the exposing means 3. As a result, an electrostatic latent image in accordance with the image formation information regarding the yellow component is formed on the photoconductive member 1.

The exposing means 3 is a means for exposing the photoconductive member 1 to an optical image of an intended image by projecting onto the photoconductive member 1 a beam of light while modulating the beam of light with the image formation information read in through an external apparatus or the like. It comprises a laser diode, a polygon mirror, a scanner motor, a focusing lens, and a reflection mirror. As image formation signals are given to the exposing means 3 from an external device or the like, its laser diode emits light in response to the image formation signals, and the light is projected in the form of a beam of light onto the polygon mirror, which is being rotated at a high speed by the scanner motor. Then, the beam of light is reflected by the polygon mirror, is projected through the focusing lens, and is projected onto the reflection mirror, so that the peripheral surface of the photoconductive member 1 is scanned by the beam of light. As a result, the numerous points of the uniformly charged peripheral surface of the photoconductive member 1 are selectively exposed, forming thereby an electrostatic latent image on the peripheral surface of the photoconductive member 1.

In synchronism with the formation of an electrostatic latent image on the photoconductive member 1, the developing apparatus 4 is driven to orbitally move one of the developing devices, for example, the yellow component developing device 4Y, into the development position. In the development position, voltage is applied to the development roller 4*a* to adhere the yellow developer to the electrostatic latent image on the photoconductive member 1, in order to develop the latent image.

Next, such voltage that is opposite in polarity to the developer is applied to the pressing roller (primary transfer roller) 5*j*, which keeps the transfer belt 50*a* pressed on the photoconductive member 1. As a result, the image on the photoconductive member 1 formed of the yellow developer, is transferred (primary transfer) onto the transfer belt 5*a*.

As the primary transfer of the image formed of the yellow developer is completed as described above, another developing device, for example, the magenta component developing device (4M), of the developing apparatus 4 is orbitally moved into the development position, and is locked into the position, where it opposes the photoconductive member 1. The above described process for forming an electrostatic latent image, process for forming a developer image, and process for transferring (primary transfer) a developer image, are sequentially repeated for magenta (M), cyan (C), and black (Bk) color components. As a result, four developer images different in color are layered on the transfer belt 5*a*.

Meanwhile, the secondary transfer roller 11 is kept in a position in which it does not contact the transfer belt 5*a*, and so is the cleaning charge roller 5*f* as a cleaning unit.

After the formation of the four developer images different in color on the transfer belt 5*a*, the secondary transfer roller 11 is pressed on the transfer belt 5*a* as shown in FIG. 1. In addition, in synchronism with this pressing of the secondary transfer roller 11, a recording medium P kept on standby in a predetermined position in the adjacencies of a pair of registration rollers 7, as a conveying means, is sent into the nip between the transfer belt 5*a* and secondary transfer roller 11.

To the transfer roller 11, such bias voltage that is opposite in polarity to the developers is being applied. Therefore, the developer images on the transfer belt 5*a* are transferred (secondary transfer) all at once onto the surface of the recording medium P as the recording medium P is sent into the nip.

Next, the recording medium P on which the developer images have been transferred as described above is conveyed to the fixing means 8 by a conveyer belt unit 12. In the fixing means 8, the plurality of developer images are fixed by the pressure roller and heat roller of the fixing means 8. Then, the recording medium P is conveyed by a pair of discharge rollers 13 along a discharge guide 15. Thereafter, the recording medium P is discharged into a delivery tray 10 on top of the color image forming apparatus A. Incidentally, designated by a referential number 18 is a conveyance roller.

Meanwhile, the cleaning charge roller 5*f* is pressed upon the transfer belt 5*a* after the transfer, and a predetermined bias voltage is applied to the cleaning charge roller 5*f*, removing thereby the residual charge from the transfer residual developer, that is, the developer which remained on the transfer belt 5*a* after the transfer. The transfer residual developer from which electrical charge has been removed is transferred back onto the photoconductive member 1 from the transfer belt 5*a*, in the nip between the photoconductive member 1 and transfer belt 5*a*; the surface of the transfer belt 5*a* is cleaned. The transfer residual developer having been transferred back onto the photoconductive member 1 is removed and recovered by the cleaning blade 6 for the photoconductive member 1. The recovered residual developer is conveyed as removed developer through a conveyance path specified therefor, and is collected into removed developer storage portion 216.

The developing apparatus 4 removably holds four development cartridges (4Bk, 4M, 4Y, and 4C) storing four developers, one for one, different in color, that is, black (Bk), magenta (M), yellow (Y), and cyan (C) developers. The development cartridges are removably fixed in predetermined positions, one for one, in the development rotary 70 of the developing apparatus 4. The development rotary 70 is rotated about its center shaft, and is provided with a pair of rotary flanges (unshown), in the form of a disc, which are solidly fixed to the two ends of the center shaft, one for one. With this solid fixation of the pair of flanges, the development cartridges do not disengage from the development rotary 70 even if the development rotary 70 rotates. In order to take a given development cartridge out of the main assembly of the image forming apparatus, the development cartridge is to be pulled by its handle (unshown); the operation for mounting or dismounting a development cartridge can be carried out by a user.

The development cartridges (4Bk, 4M, 4Y, and 4C) have a developer storage portion and a development portion. The developer storage portion is filled with developer of a specific color. As a stirring means rotates, the developer is conveyed to the development portion. In the development portion, as a developer supply roller rotates, the developer from the developer storage portion is supplied to the surface of the development roller. In addition, the developer is formed into a thin layer by the development blade, while being electrically charged by the friction between the developer and the combination of the development blade and development roller. Then, as development bias is applied to the development roller while the development roller is rotated, the thin layer of the developer on the development roller develops the electrostatic latent image on the photoconductive drum. Next, referring to FIGS. 2–7, a single-piece process cartridge formed by unitizing the photoconductive member unit and intermediary transfer member unit will be described.

Figure 2:
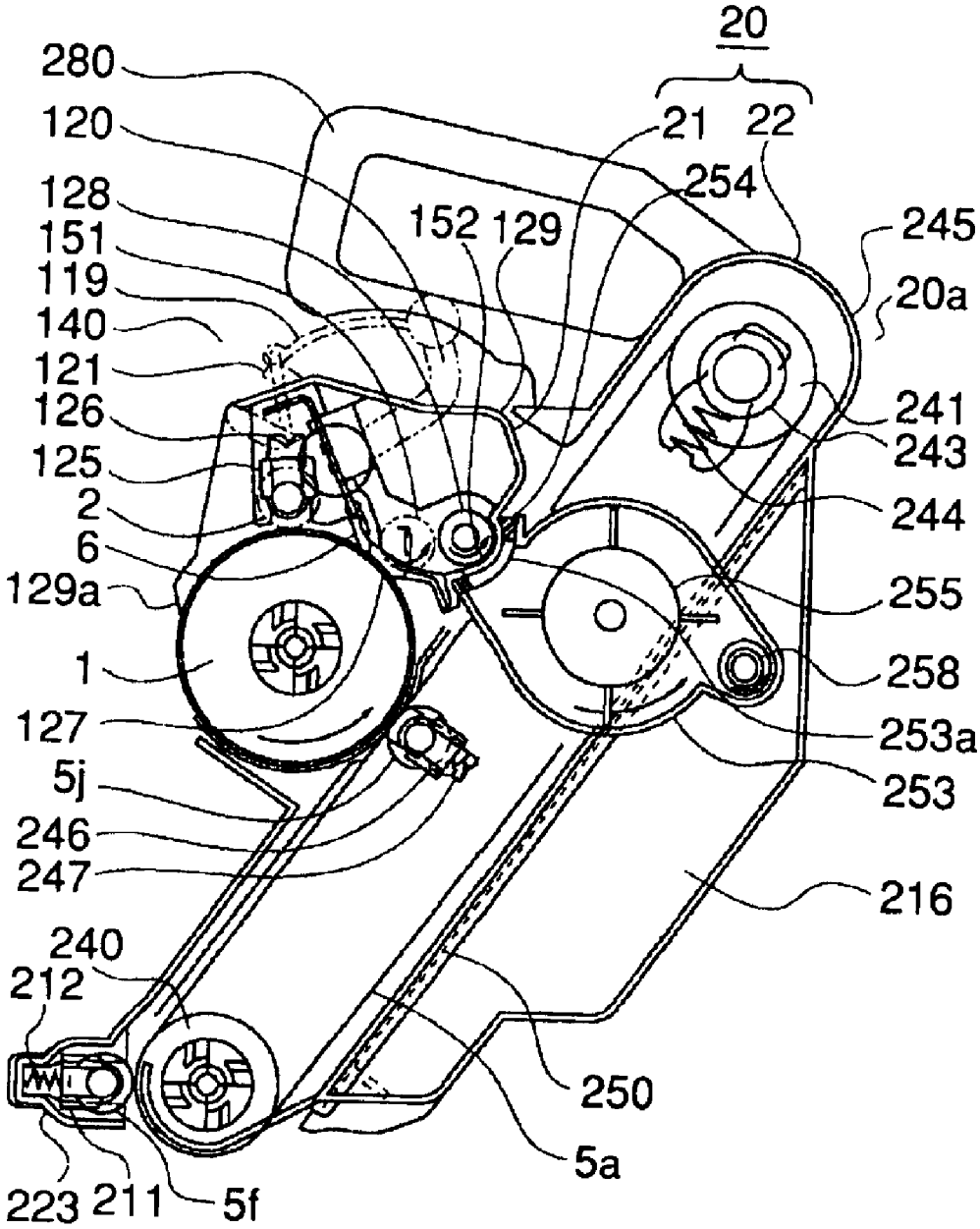
FIG. 2 is a vertical sectional view of the left end portion of the process cartridge, at a plane parallel to the lateral walls of the image forming apparatus.
Figure 3:
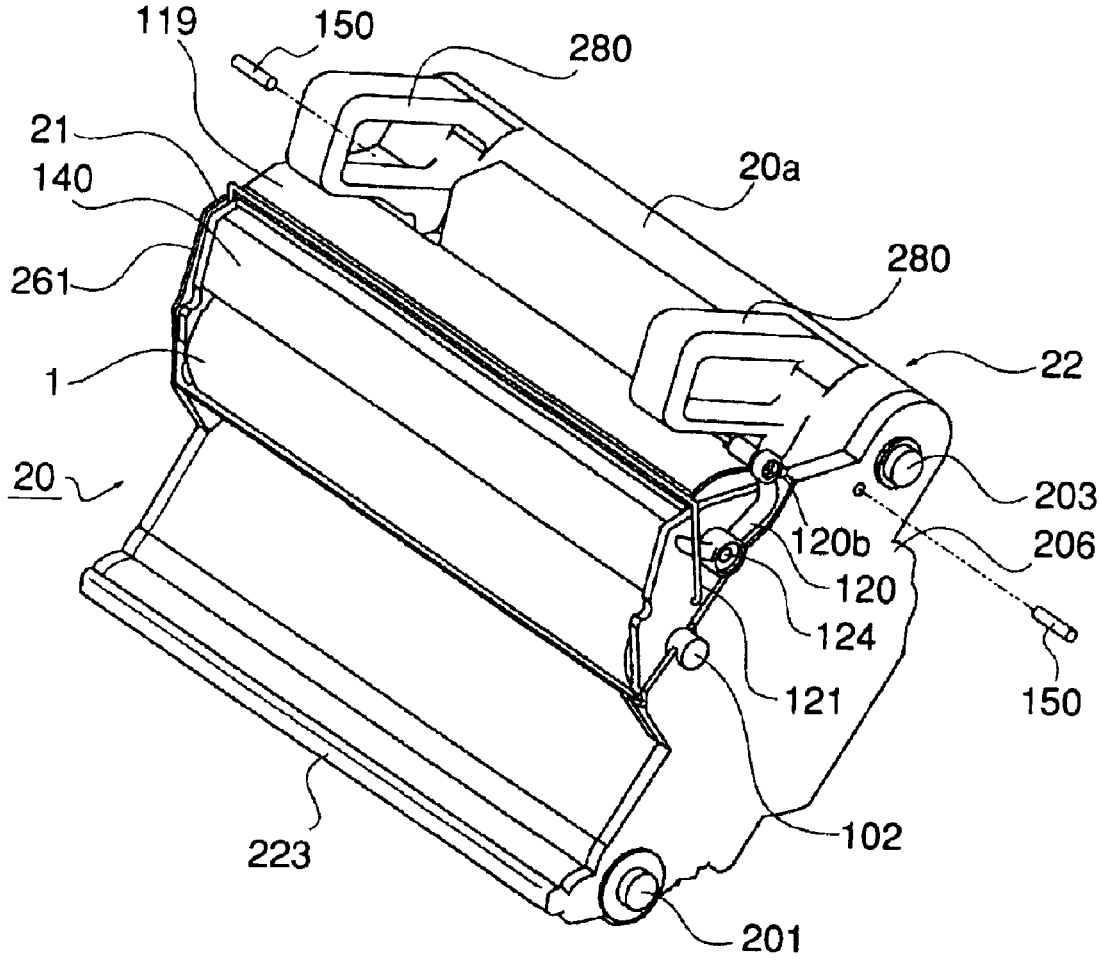
FIG. 3 is a perspective view of the process cartridge, as seen from the left side.
Figure 4:
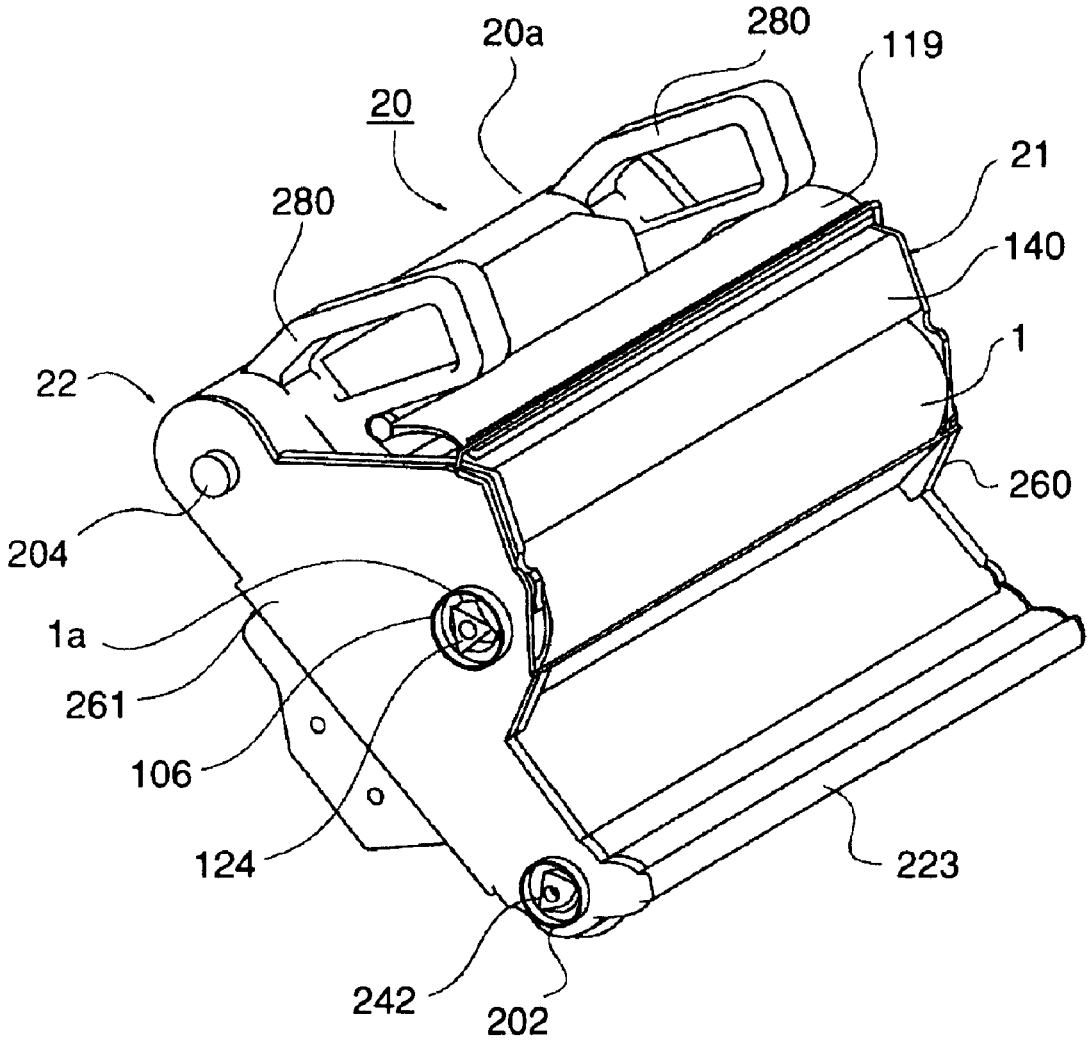
FIG. 4 is a perspective view of the process cartridge, as seen from the right side.
Figure 5:
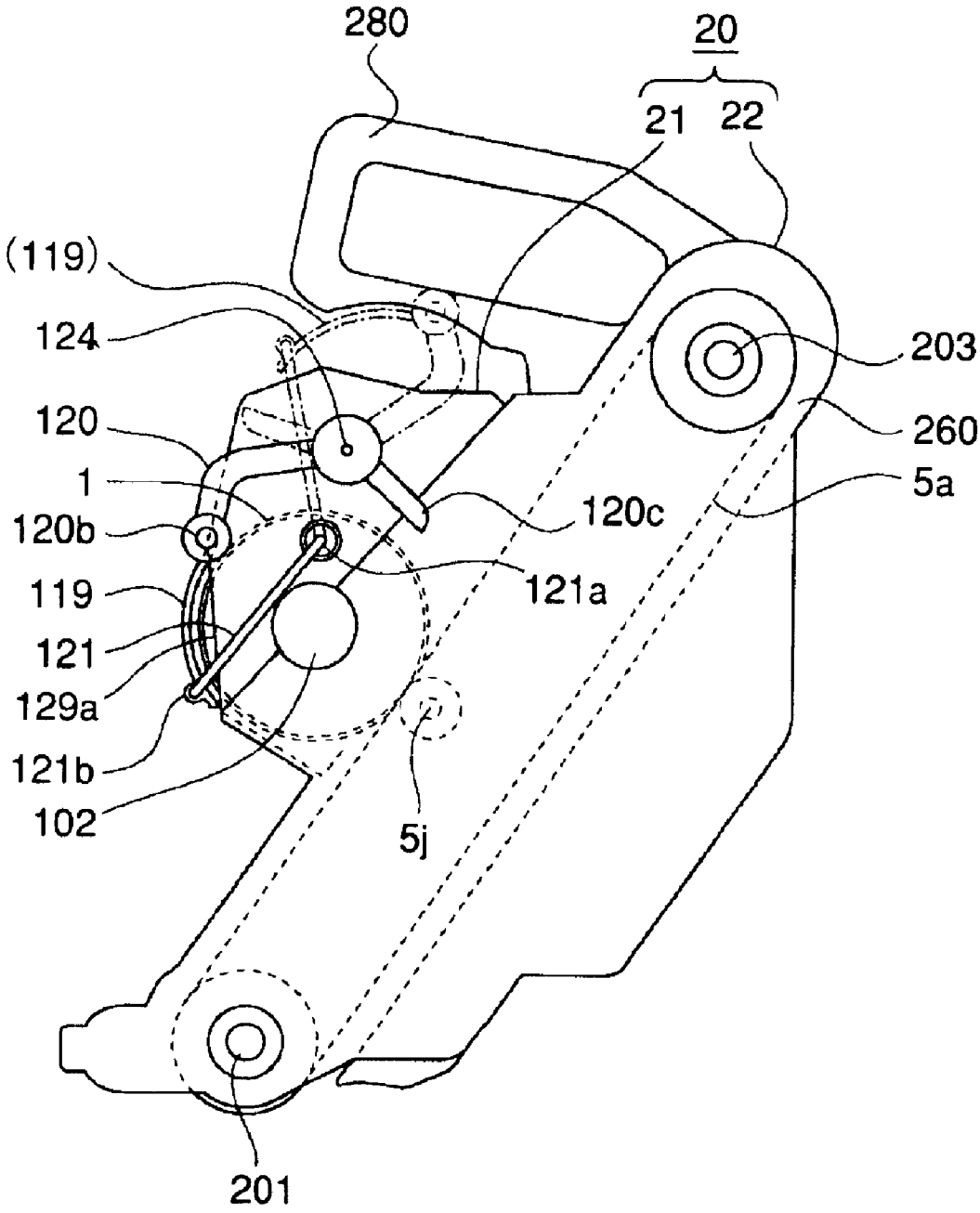
FIG. 5 is a plan view of the left side of the process cartridge, for showing the structure of the drum shutter of the process cartridge.
Figure 6:
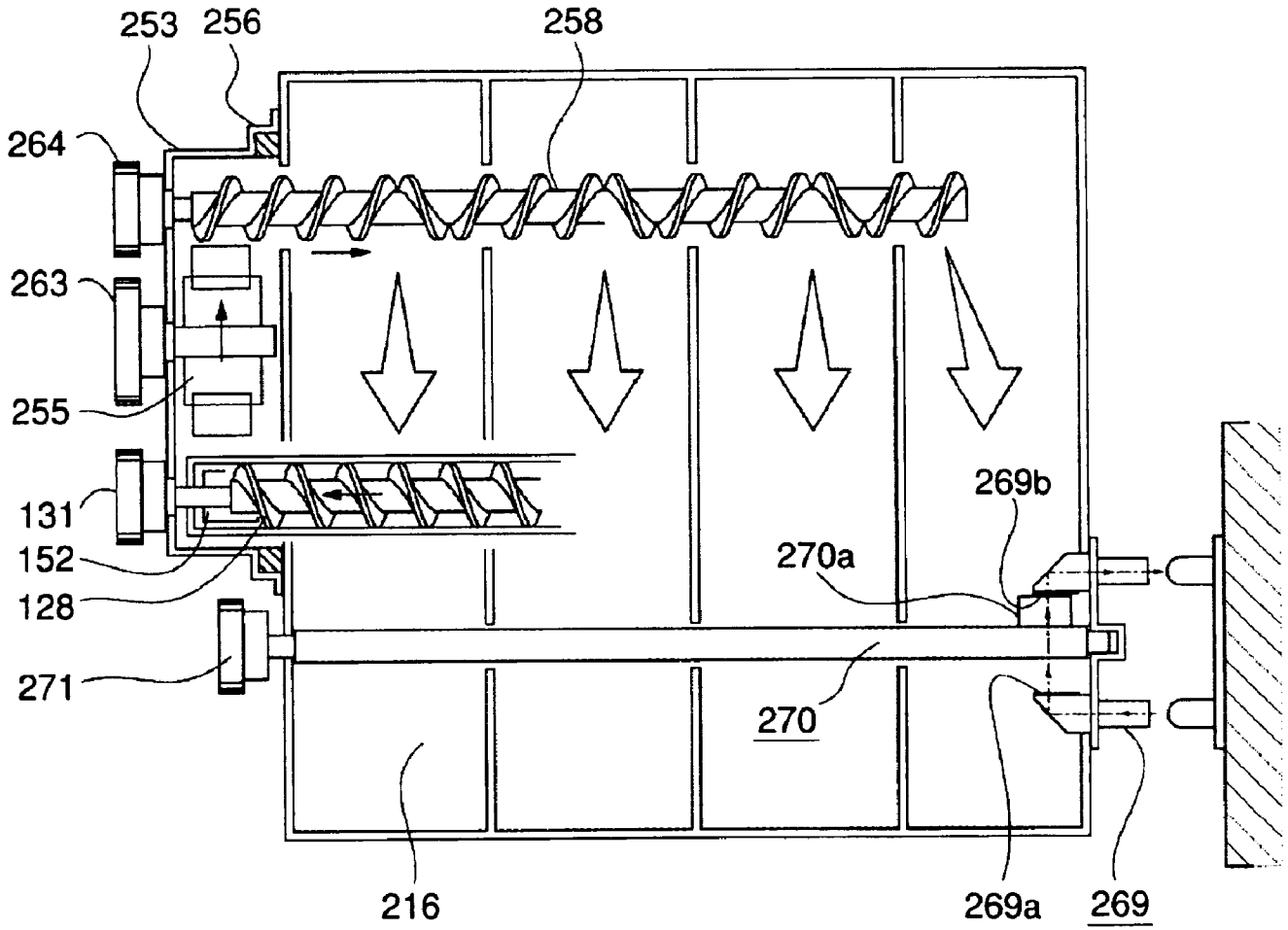
FIG. 6 is a horizontal sectional view of the removed developer storage box of the process cartridge.
Figure 7:
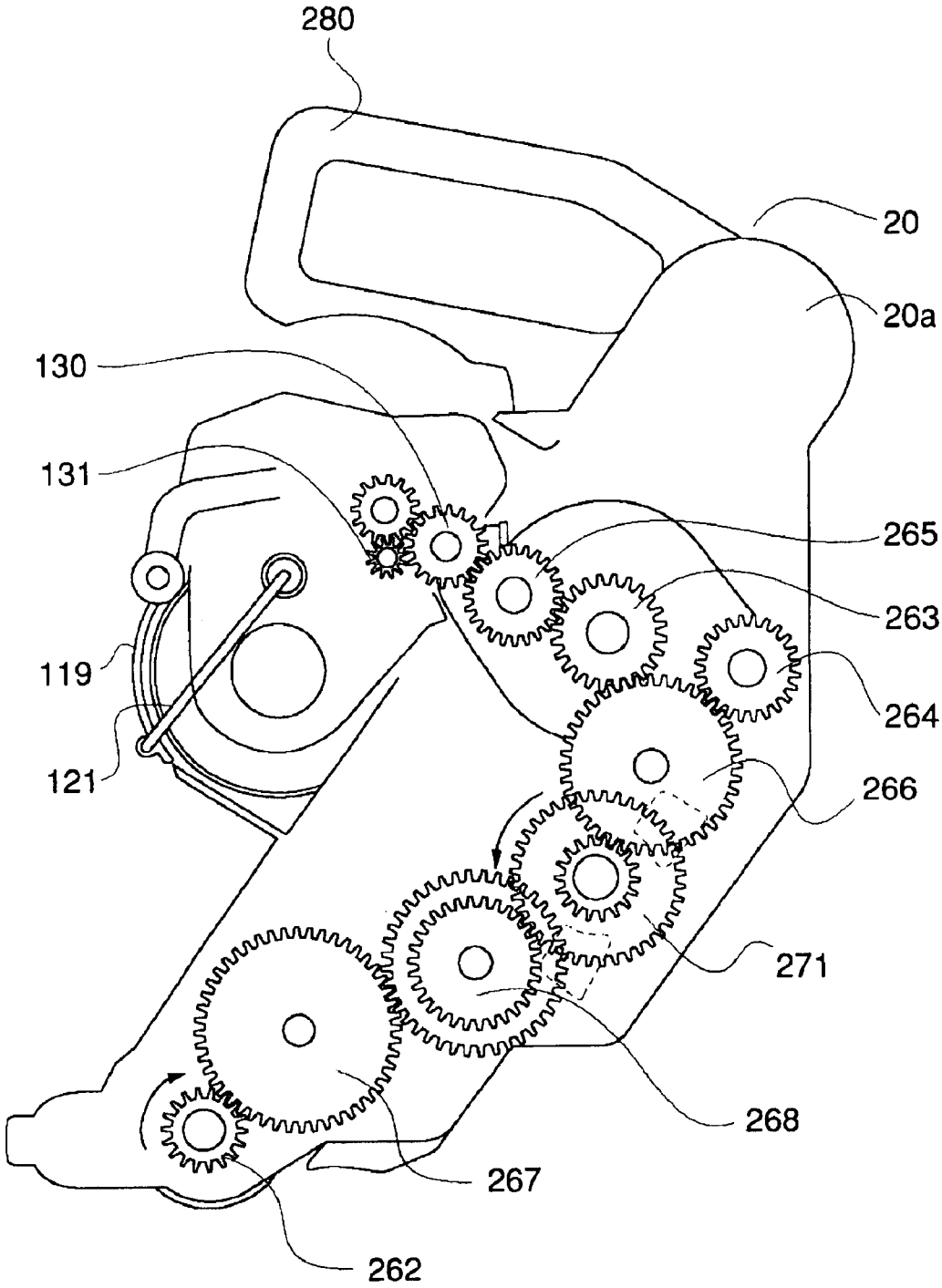
FIG. 7 is a plan view of the left side of the process cartridge, from which the left side cover has been removed.

FIG. 2 is a vertical sectional view of the left side of the process cartridge 20 as seen from the front side of the image forming apparatus, and FIG. 3 is a perspective view of the cartridge 20 as seen from the left side. FIG. 4 is a perspective view of the cartridge 20 as seen from the right side, and FIG. 5 is a side view of the cartridge 20, for showing the structure of the drum shutter. FIG. 6 is a sectional view of the removed developer storage box 216, at a plane parallel to the bottom of the image forming apparatus, and FIG. 7 is a left side view of the cartridge 20, the left side cover of which has been removed. Referring to FIG. 2, the cartridge 20 comprises a drum unit 21 and a transfer member unit 22. The drum unit 21 has the photoconductive drum, and a photoconductive member frame 129 for rotationally supporting the photoconductive member 1. The transfer member unit 22 has the transfer belt 5*a* and removed developer storage portion 216. The drum unit 21 is above the transfer member unit 22, in terms of the direction in which the cartridge 20 is projected in FIG. 6. The left and right side covers 260 and 261 (FIGS. 3 and 4) are solidly fixed to the lengthwise ends of the transfer member unit 22, one for one. The covers 260 and 261 extend far enough to cover the lengthwise ends of the photoconductive member unit 21 as well, holding thereby the photoconductive member unit 21 from the lengthwise ends thereof.

In the drum unit 21, the photoconductive drum 1 is rotationally attached to the photoconductive member frame 129 (cartridge frame 20*a*) with the interposition of the left bearing 102 (FIG. 3) and right bearing 106 (FIG. 4). A predetermined amount of force for rotationally driving the photoconductive drum 1 is transmitted to the photoconductive drum 1 from the main assembly of the image forming apparatus through a coupling 124 (FIG. 4) attached to the right lengthwise end of the photoconductive member 1.

Referring to FIG. 2, the photoconductive member 1 is in contact with the charge roller 2, which is kept pressed upon the photoconductive member 1 by a pair of compression springs 126, with the interposition of a pair of bearings 125 located at the lengthwise ends of the charge roller 2 one for one. With the provision of this structural arrangement, the charge roller 2 is rotated by the rotation of the photoconductive member 1. At least one of the pair of bearings 125 is formed of an electrically conductive material, so that a predetermined charge bias voltage can be applied to the charge roller 2 through the bearing 125 to uniformly charge the peripheral surface of the photoconductive member 1. Incidentally, the charge roller 2, bearings 125, and springs 126 are integral parts of the charge roller unit 140.

The drum unit 21 is provided with a drum shutter 119, which is opened or closed by the operation for mounting the cartridge 20 into the image forming apparatus main assembly 100, or removing it therefrom, respectively. The shutter 119 is for protecting the drum 1.

Figure 10:
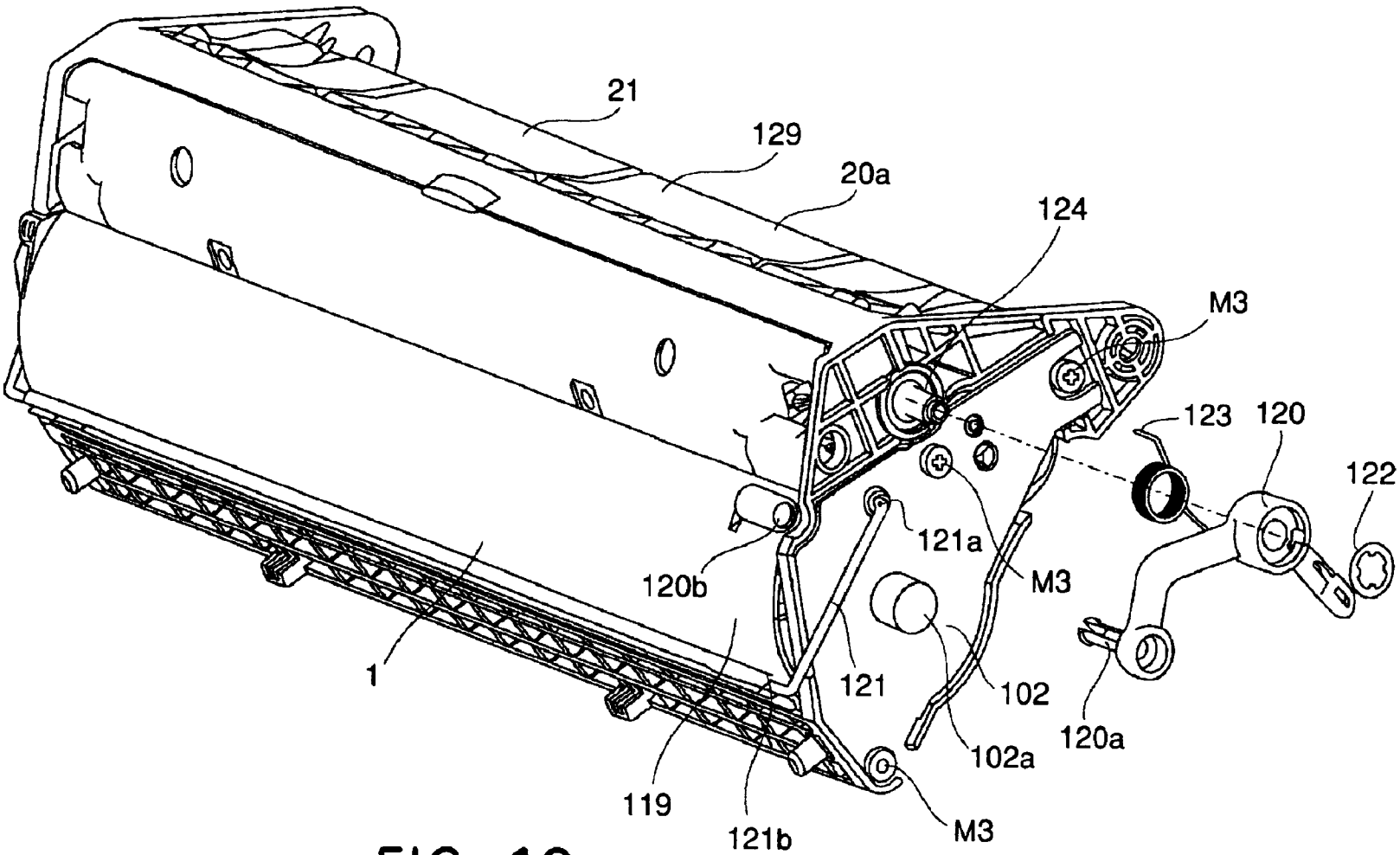
FIG. 10 is a perspective view of the process cartridge, for showing how to remove the shutter from the process cartridge (cartridge frame).

The shutter 119 is rotatably attached to the side covers 260 and 261, with the interposition of an auxiliary arm 121, one end of which is rotatably attached to the arm attachment portion 121*a* of the cover 260, and the other end is rotatably attached to the arm attachment portion 121*b* of the shutter 119. Further, the drum unit 21 is provided with an arm 120, which is under the pressure generated by the resiliency of a spring 123 in the closing direction of the shutter 119. The arm 120 is rotatably attached to the shutter shaft 124 of the cover 260. One end of the arm 120 is provided with a claw 120*a*, with which the arm 120 is attached to the arm attachment portion 120*b* of the shutter 119. Designated by a referential number 122 is a retainer ring, which prevents the arm 120 from disengaging from the shaft 124 (FIGS. 3 and 10).

The cartridge frame 20*a* (photoconductive member frame 129) holds the cleaning blade 6, which is attached to a predetermined portion of the cartridge frame 20*a*. The transfer residual developer, that is, the developer remaining on the transfer belt 5*a* after the image transfer from the transfer belt 5*a*, is recovered onto the photoconductive member 1, and then, is scraped away, along with the development residual developer, that is, the developer remaining on the photoconductive member 1 after the image transfer from the photoconductive member 1, by the blade 6. After being scraped away from the photoconductive member 1 by the blade 6, the removed developer is stored in the removed developer storage portion 216 of the transfer member unit 22. The means for conveying the removed developer to the removed developer storage portion 216 will be described later.

Next, the intermediary transferring apparatus 5, which constitutes the transfer member unit 22, will be described. The transfer belt 5*a* of the transferring apparatus 5 is stretched around the driving roller 240 and following roller 241, which are supported by the frame 245 of the transfer member unit 22. The driving roller 240 is rotatably attached to the transfer member unit 22 by its lengthwise ends, with the interposition of the left bearing 201 (FIG. 3) and right bearing 202 (FIG. 4). A predetermined amount of force for rotationally driving the driving roller 240 is transmitted to the driving roller 240 through the coupling 242 (FIG. 4) attached to the right lengthwise end of the driving roller 240. A pair of bearings 243 which are supporting the following roller by its lengthwise ends, are provided with a pair of compression springs 244, one for one, which provide the transfer belt 5*a* with a predetermined amount of tension.

The transferring apparatus 5 is provided with a primary transfer roller 5*j*, which is positioned in a manner to sandwich the transfer belt 5*a* between itself and photoconductive member 1, being supported by a pair of bearings 246, by its lengthwise ends. The primary transfer roller 5*j* is kept pressed against the photoconductive member 1 by the resiliency of a pair of compression springs 247, with the transfer belt 5*a* sandwiched between the primary transfer roller 5*j* and photoconductive member 1. With the provision of this structural arrangement, the primary transfer roller 5*j* is rotated by the rotation of the photoconductive member 1. At least one of the pair of bearings 246 is made of an electrically conductive material, making it possible to apply a predetermined transfer bias voltage to the primary transfer roller 5*j* in order to transfer (primary transfer) the developer on the photoconductive member 1 onto the transfer belt 5*a*.

The transferring apparatus 5 is also provided with a cleaning charge roller portion 223, which is positioned in a manner to oppose the driving roller 240, with the interposition of the transfer belt 5*a*. The residual electrical charge of the residual developer on the transfer belt 5*a* is removed by the cleaning charge roller portion 223; it is removed by applying a predetermined bias to the cleaning charge roller 5*f* of the cleaning charge roller portion 223. The cleaning charge roller 5*f* is supported by a pair of bearings 211, by its lengthwise ends. Further, the cleaning charge roller 5*f* is kept pressed against the driving roller 240, with the transfer belt 5*a* sandwiched between the two rollers 5*f* and 240, by a pair of compression springs 212. With the provision of this structural arrangement, the cleaning charge roller 5*f* is rotated by the rotation of the transfer belt 5*a* (driving roller 240). At least one of the pair of bearings 211 is made of an electrically conductive material. To the cleaning charge roller 5*f*, a predetermined bias voltage is applied so that the residual electrical charge of the developer on the transfer belt 5*a* is removed. Then, the residual developer on the transfer belt 5*a* is electrostatically transferred back onto the photoconductive member 1, in the primary transfer nip, and is removed from the photoconductive member 1 by the cleaning blade 6. Then, the removed residual developer is stored in the removed developer storage portion 216, as described before.

Next, the residual developer conveying means, that is, the means for conveying the removed residual developer will be described.

The transfer member unit 22 has the removed developer storage portion 216, which is located on the opposite side of the transfer belt 5*a* with respect to the photoconductive member unit 21. The removed developer storage portion 216 comprises a part of the intermediary transfer member frame 245 and a certain number of partitioning plates 250 welded thereto. It is the final storage for the residual developer from the photoconductive member 1.

Figure 16:
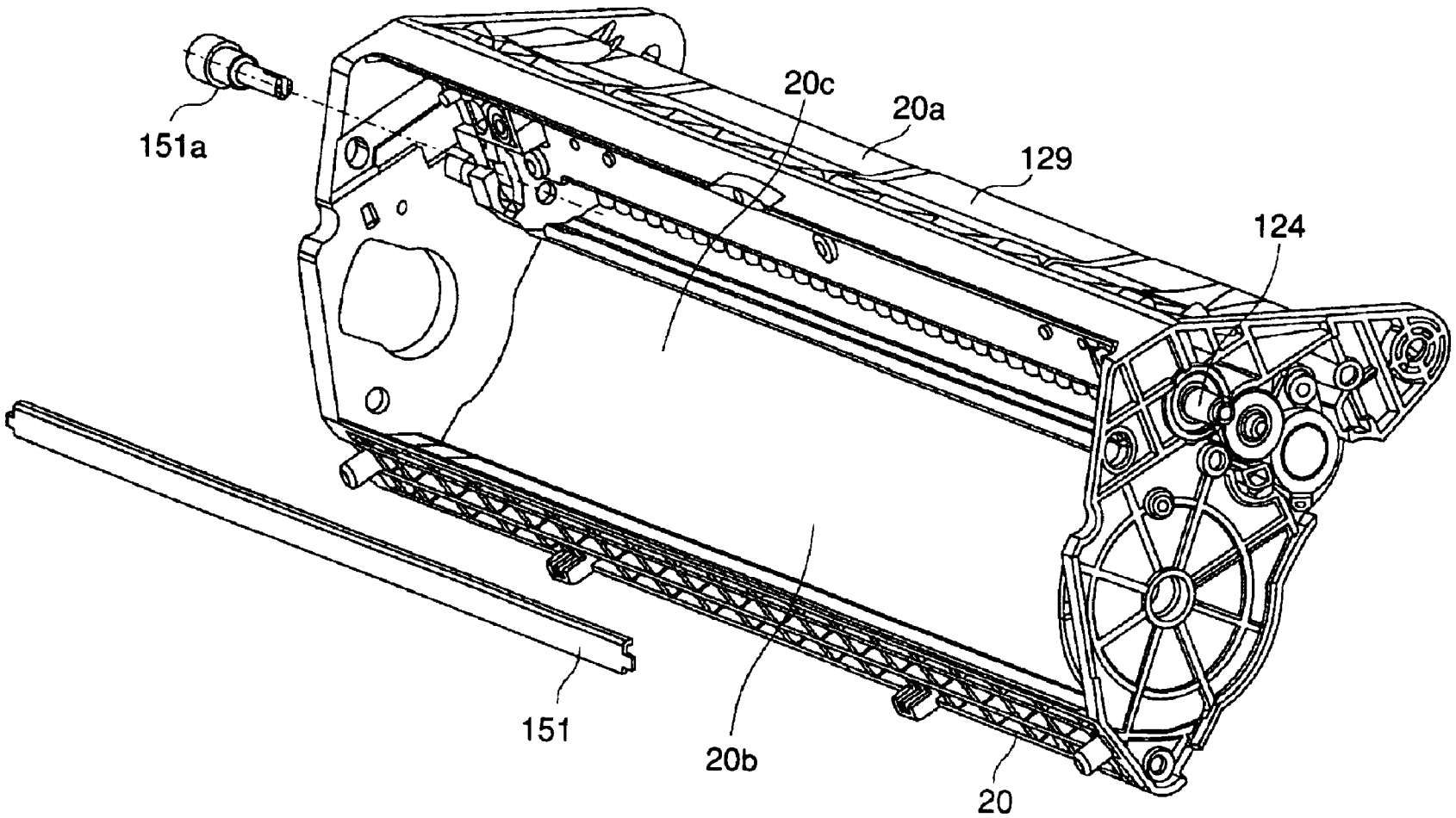
FIG. 16 is a perspective view of the process cartridge, for showing how to remove the cleaning (sweeping) blade from the process cartridge (cartridge frame).

As the residual developer is scraped away from the photoconductive member 1 by the blade 6, it is prevented by a developer catching sheet 124 from falling onto the transfer belt 5*a*, and accumulates on the developer catching sheet 124. Then, as a developer conveying sweeping blade 151 is rotated, the removed developer having accumulated on the developer catching sheet 124 is swept into the deeper section of the photoconductive member frame 129, that is, swept out in the direction to be moved away from the photoconductive member 1. Then, it is conveyed further leftward, as seen from the front side of the apparatus (frontward in FIG. 2), by the rotation of a first screw 128 located more inward of the photoconductive member frame 129 than the developer conveying sweeping blade 151. The sweeping blade 151 is rotatably supported by the frame 20*a* with the interposition of a pair of sweeping blade bearings 151*a* (FIG. 16). The frame 20*a* is provided with a hole 152, which is at the left lengthwise end of the first screw 128, and through which the removed developer falls after being conveyed leftward by the first screw 128. Then, the removed developer is sent to the receiving hole 253*a* of a cover 253 for a bladed wheel 255, which leads to the removed developer storage portion 216. The frame 20*a* is provided with a sealing member 254, which is attached to the bottom edge of the hole 152, preventing thereby the developer from leaking from the joint between the holes 152 and 253*a*. The box 216 is a part of the unit 22. Referring to FIG. 5, the cover 253 for the bladed wheel 255 is attached to the left side of the transfer member frame (cartridge frame 20*a*) 245, with a sealing member 256 sandwiched between them. Disposed on the inward side of the cover 253 is the bladed wheel 255, which is rotated in the counterclockwise direction, as seen from the left side, conveying thereby the removed developer toward the box 216. The cover 253 overlaps with the left side of the storage portion 216. The portion of the cover 253, which overlaps with the storage portion 216, is provided with a hole, which leads to the interior of the bladed wheel cover 253. Further, the frame 20*a* is provided with a second screw 258, which extends through this hole of the overlapping portion, in the lengthwise direction of the frame 20*a*. Thus, as the screw 258 is rotated, the removed developer having been conveyed thereto by the bladed wheel 255 is conveyed from the left side of the storage portion 216 to the deeper end of the right side thereof. The storage portion 216 has a plurality of small chambers created by partitioning the storage portion 216 with the plurality of vertical partitioning walls. As the removed developer is conveyed into the storage portion 216, the small chambers of the storage portion 216 are sequentially filled, starting from the leftmost chamber. The rightmost chamber is provided with a detection portion 269 for detecting that the box 216 is full of the developer. The detection portion 269 comprises a light emitting portion and a light receiving portion. It compares the amount of the light the light receiving portion receives when there is no removed developer, with the amount of the light receiving portion receives when the light from the light emitting portion is blocked by the removed developer, in order to determine whether or not the storage portion 216 is full. Further, the detection portion 269 is provided with a wiping member 270 for wiping the light emitting surface 269*a* and light receiving surface 269*b*. The wiping member 270 comprises: a rotational axle 270*b* located at the mid point between the light emitting surface 269*a* and light receiving surface 269*b*; and a piece of flexible sheet 270*a* attached to the rotational axle 270*b*. Thus, as the rotational axle 270*b* is rotated, the piece of flexible sheet 270*a* wipes away the residual developer on the light emitting surface 269*a* and light receiving surface 296*b*.

Next, referring to FIG. 7, the structural arrangement for transmitting driving force to the residual developer conveying means will be described.

Figure 18:
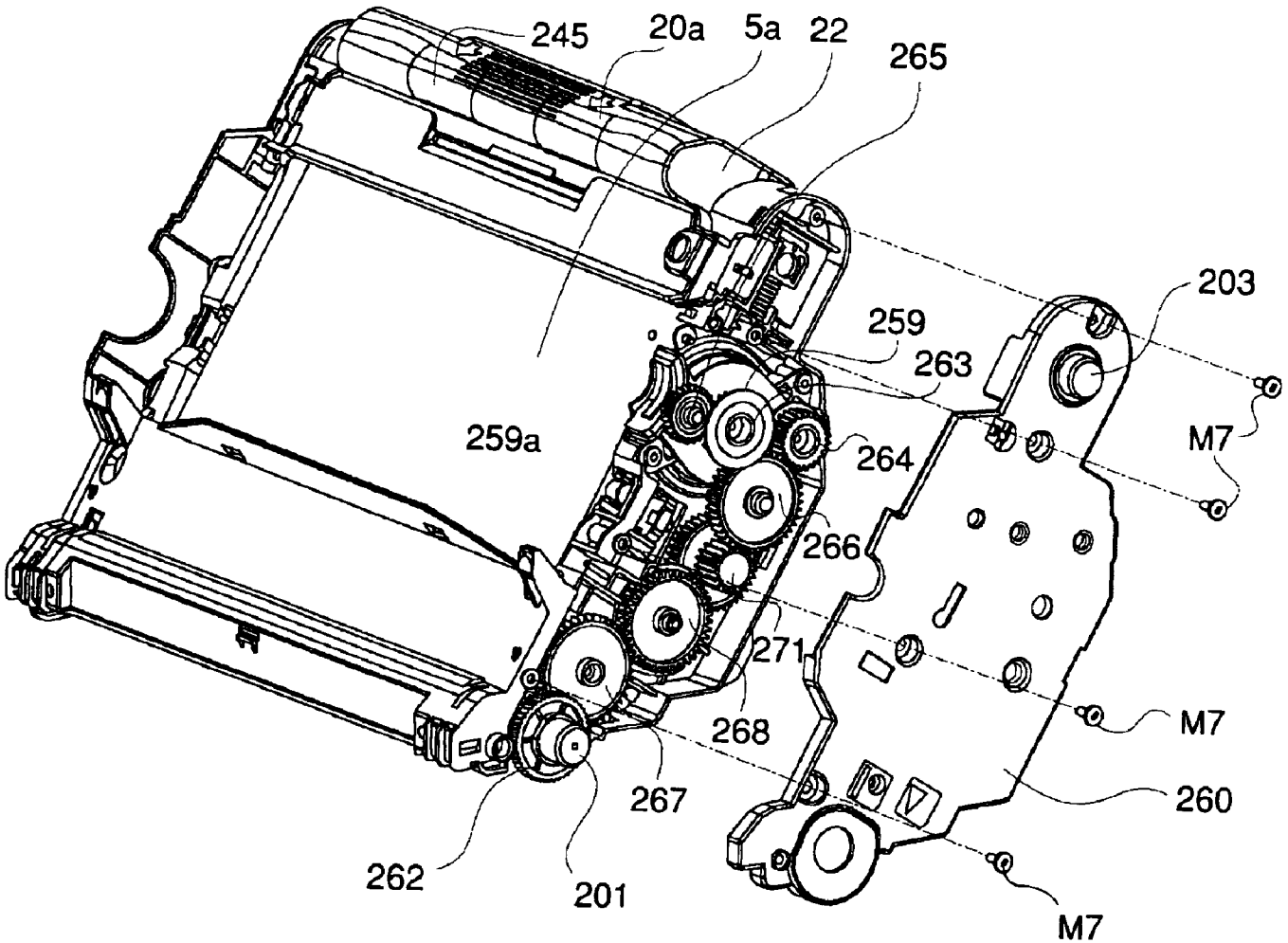
FIG. 18 is a perspective view of the process cartridge, for showing how to remove the side cover from the transfer member unit.
Figure 19:
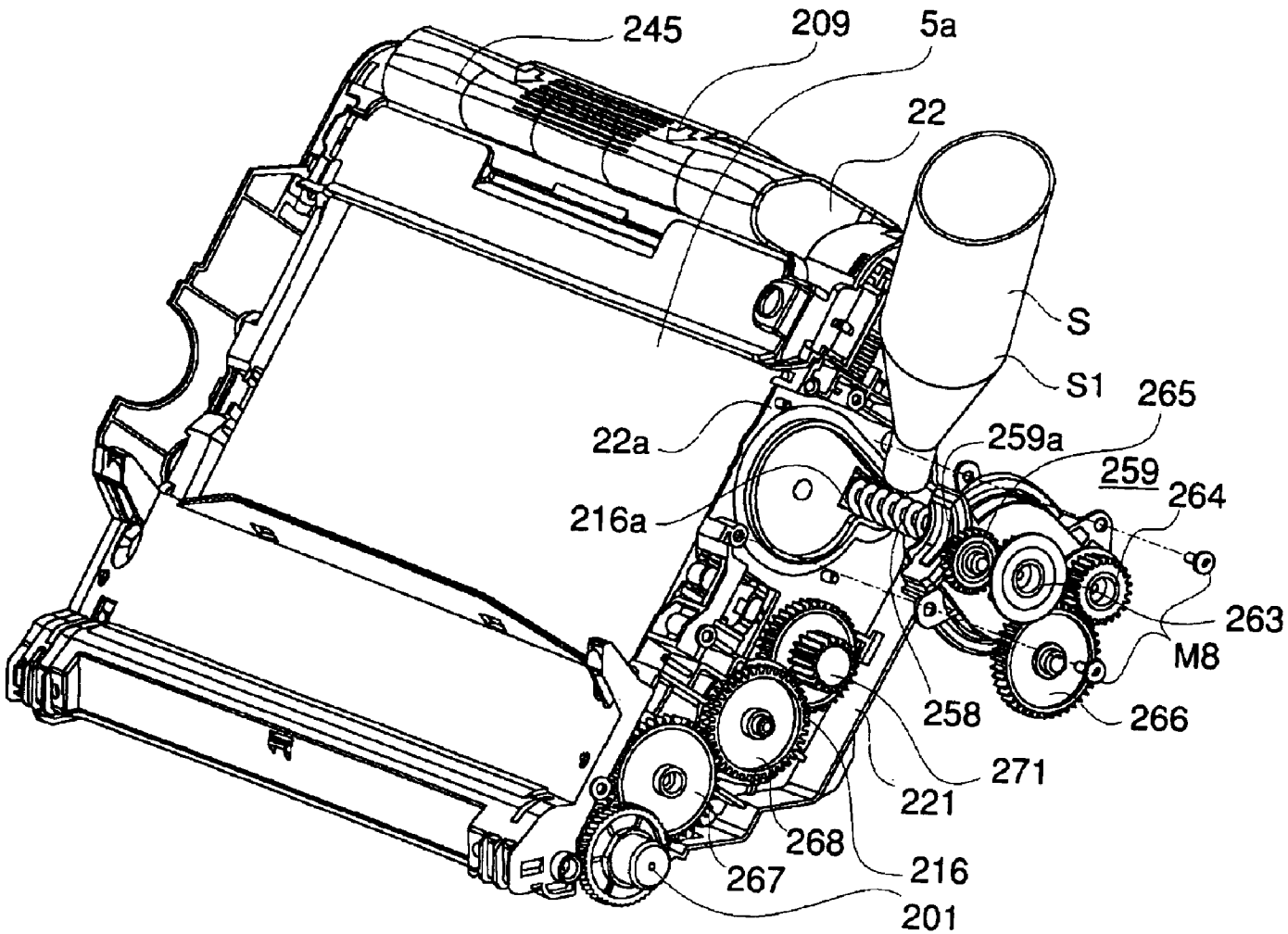
FIG. 19 is a perspective view of the process cartridge, for showing how to remove the bladed wheel unit from the transfer member unit.

As described above, a predetermined amount of force for rotationally driving the photoconductive member 1 and driving roller 240 are transmitted thereto from the main assembly of the image forming apparatus through couplings 124 and 242 located at the right lengthwise end of the process cartridge 20. The driving roller 240 is provided with a gear 262 which is attached to the left lengthwise end of the driving roller 240. The force from the apparatus main assembly is further transmitted to a gear 271 attached to the lengthwise end of the rotational shaft 270*b* of the aforementioned wiping member 270 from the gear 262 through two gears 267 and 268. The gear 271, and the gear 268, that is, the gears immediately preceding the gear 262 in terms of the driving force transmission direction, are step gears. Thus, the speeds at which the driving portion related to the residual developer conveyance, that is, the portions on the downstream side in terms of the driving force transmission direction, are rotationally driven, are slower than the speed at which the driving roller 240 is driven. Further, the driving force is transmitted from the gear 271 through the gear 266 to a gear 264 attached to the second screw 258, and a gear connected to the bladed wheel 255. Then, the driving force is transmitted from the bladed wheel gear 263 to a gear 265 located next to the photoconductive member unit 21. The above listed gears, that is, the gears from the gear 262 to the gear 265, are disposed on the left side of the intermediary transfer unit 22. In comparison, the photoconductive member unit 21 is provided with a gear 130, which is attached to the left lateral wall of the photoconductive member unit 21, being located next to the intermediary transfer unit 22. The gear 130 is attached to the first screw 128, and receives the driving force from the gear 265. From the gear 130, the driving force is transmitted through another gear to a gear 131 attached to the aforementioned developer conveying sweeping blade 151. The gears 130 and 131 are attached to the bladed wheel unit 259, as shown in FIGS. 18 and 19. To the unit 259, one end of the second screw 258 is attached.

As described above, the process cartridge 20 is structured so that all the gears involved in the residual developer conveyance are disposed at the left end of the process cartridge 20 to transmit the driving force to the residual developer conveying means.

Next, the method for remanufacturing the process cartridge 20 will be described (FIGS. 8-20).

First, the method for removing the photoconductive member 1 from the process cartridge 20 (frame 20*a*) will be described.

(1) Method for Removing Drum 1 (Attachment Process is Reversal to Removal Process)

Figure 8:
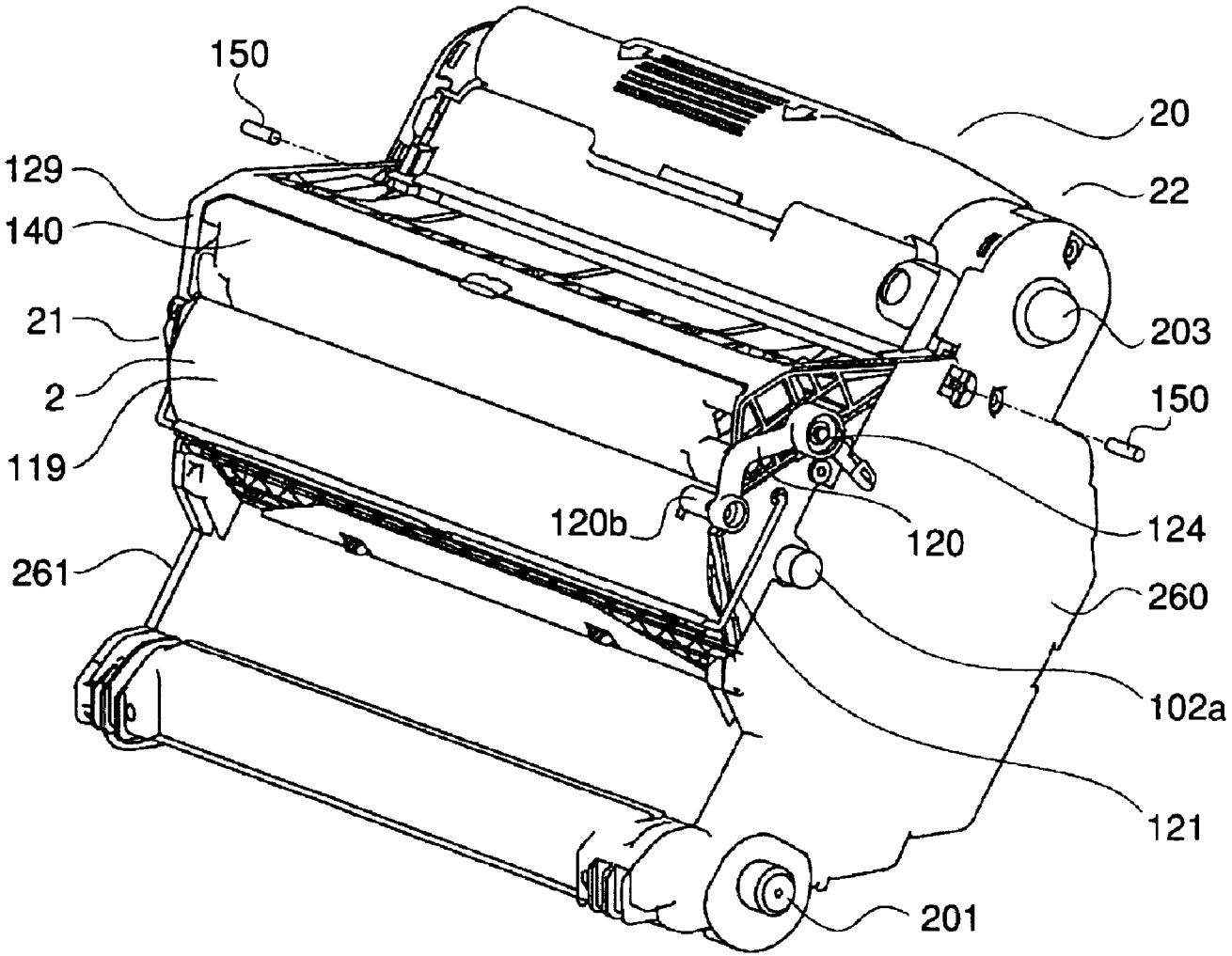
FIG. 8 is a perspective view of the process cartridge, for showing how to remove pins.

1. Remove the left and right pins 150 and 151 by pinching them with a nipper or the like (FIGS. 3 and 8).

Figure 9:
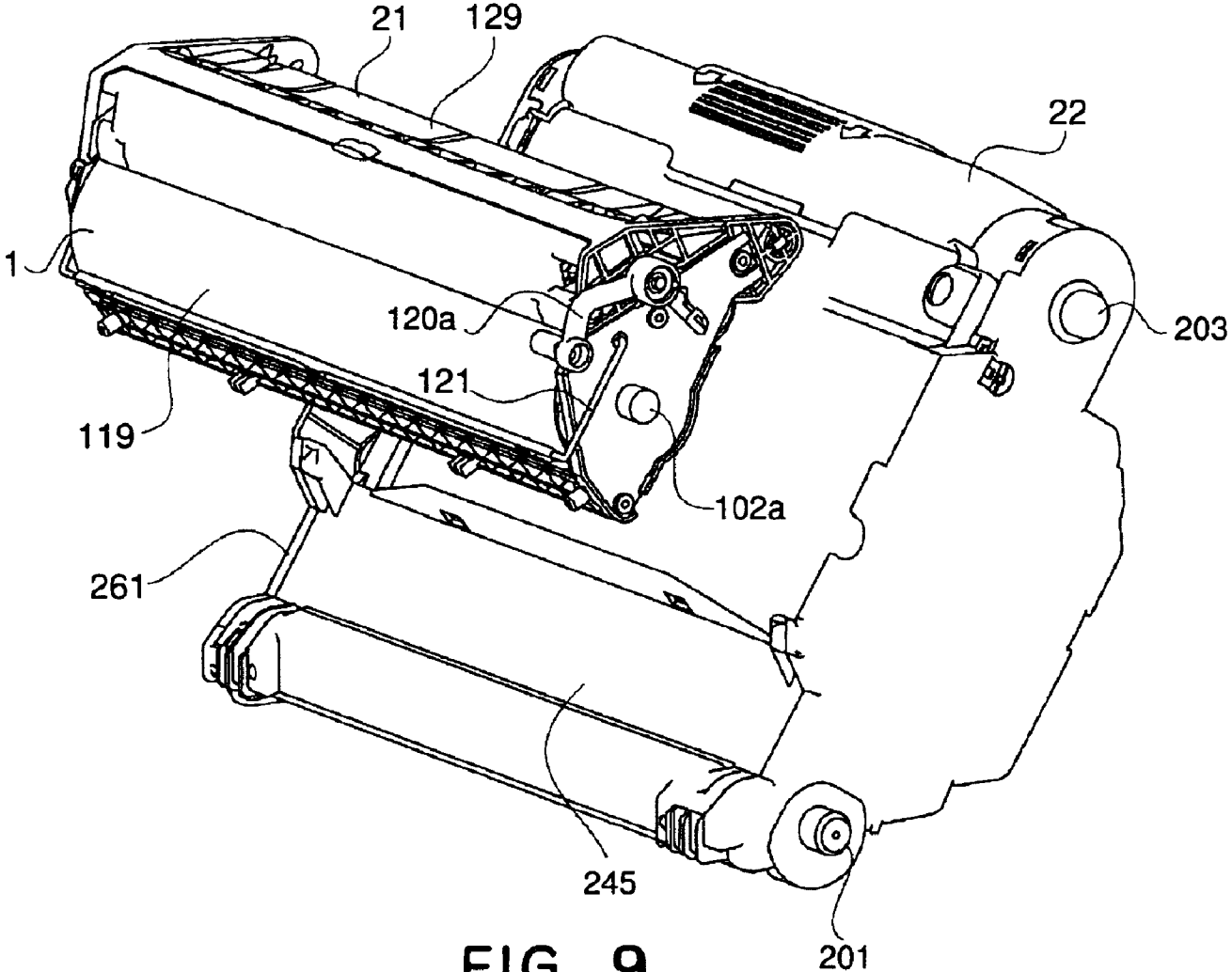
FIG. 9 is a perspective view of the process cartridge, for showing how to remove the photoconductive member unit from the process cartridge (cartridge frame).

2. Separate the drum unit 21 from the transfer member unit 22; pull the rear portion of the drum unit 21 frontward from the transfer member unit 22 (FIG. 9).

3. Remove the retainer ring 122 from the shutter shaft 124, and remove the claw 120*a* of the arm 120 from the arm attachment portion 120*b* of the shutter 119 to remove the arm 120 from the shutter 119 and cover 260. Then, remove the spring 128 on the inward side of the cover (FIG. 10).

Figure 11:
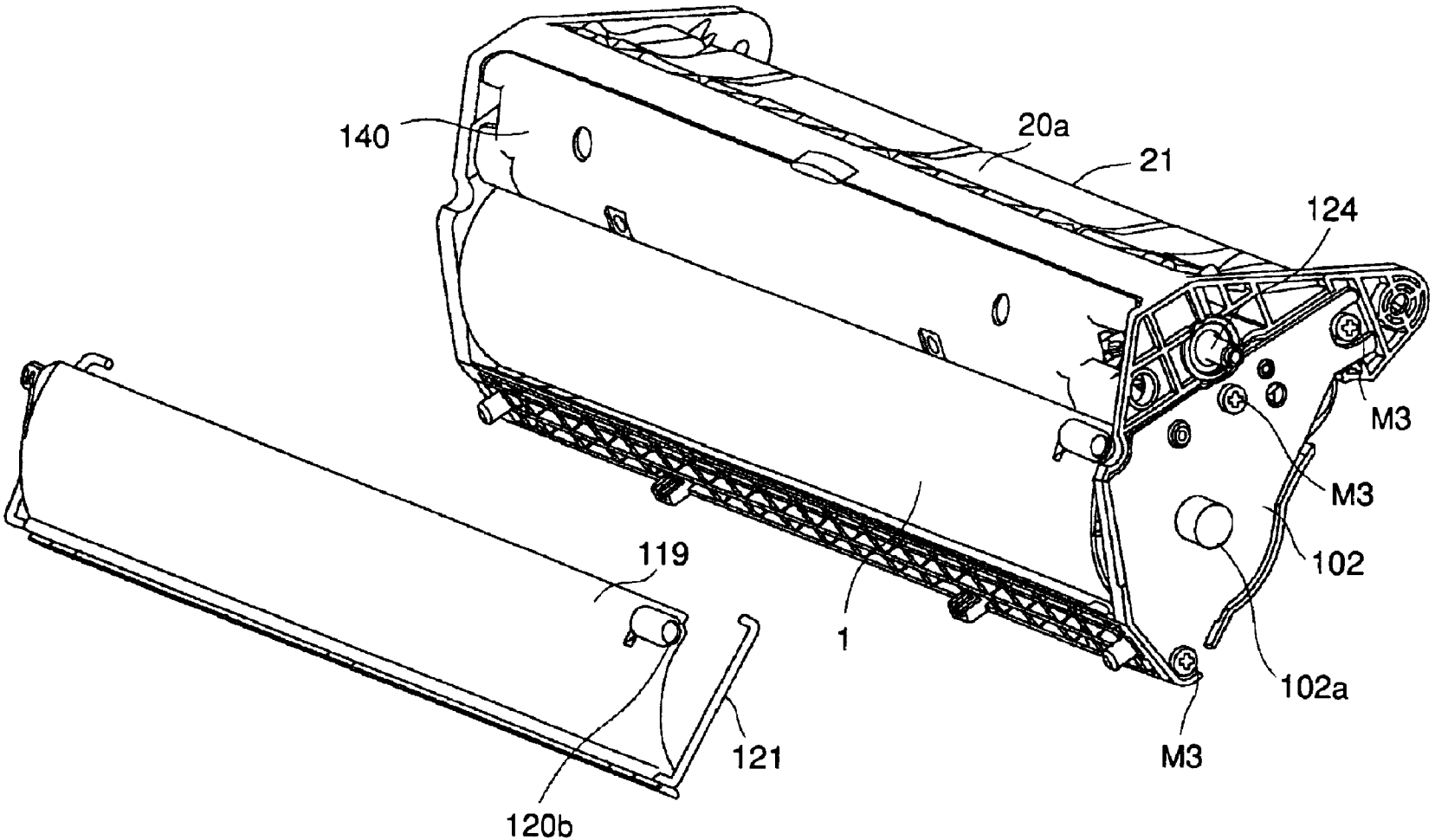
FIG. 11 is also a perspective view of the process cartridge, for showing how to remove the shutter from the process cartridge (cartridge frame).

4. Remove the auxiliary arm 121 from the auxiliary arm attachment portions 121*a* of the covers 260 and 261 by widening the distance between the opposing ends of the auxiliary arm 121 by pushing the opposing ends with hands, and remove the combination of the shutter 119 and auxiliary arm 121 from the covers 260 and 261 (FIG. 11). Incidentally, the auxiliary arm attachment portion 121*a* of the cover 261 is not shown.

Figure 12:
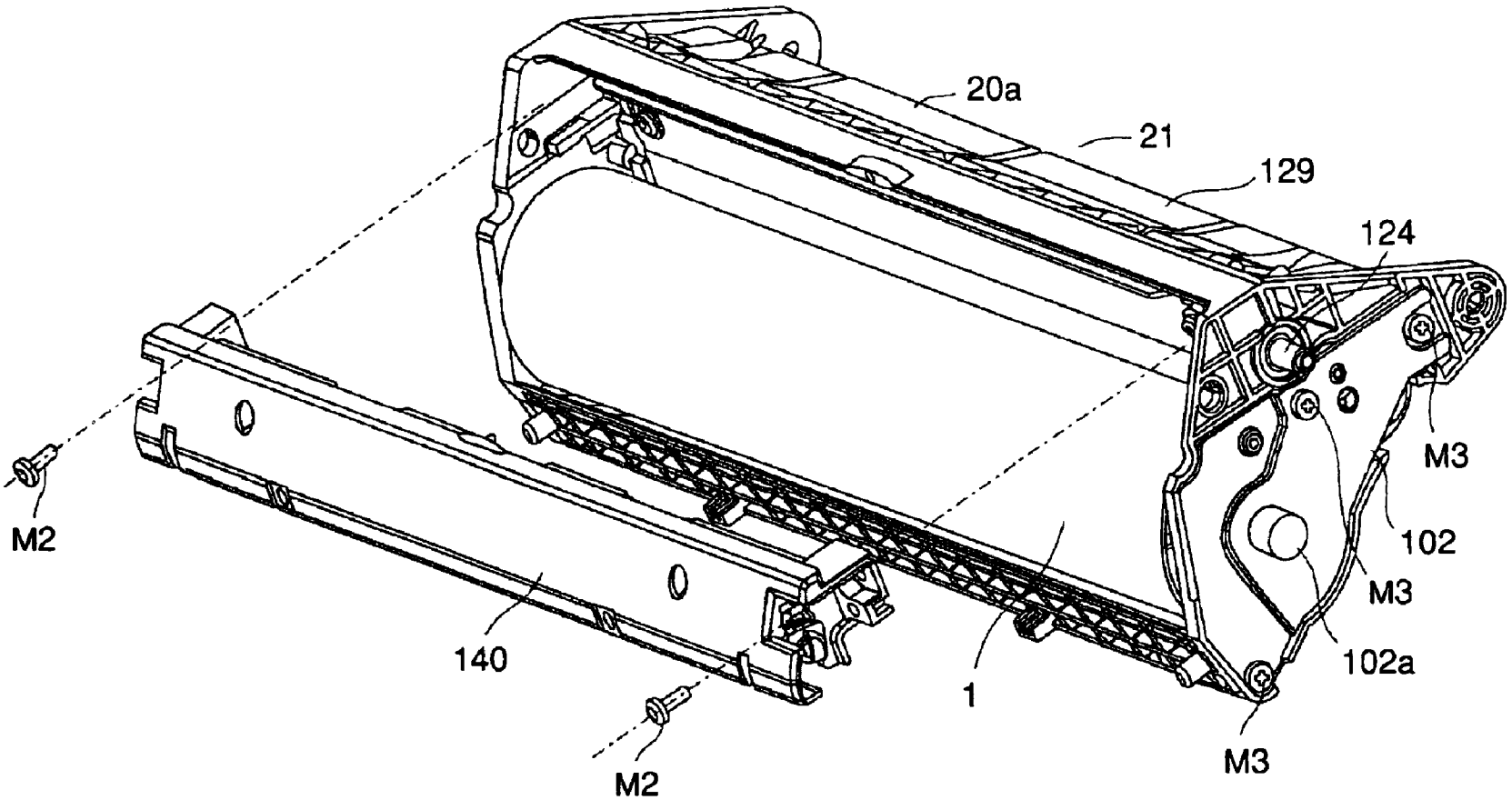
FIG. 12 is a perspective view of the process cartridge, for showing how to remove the charge roller unit from the process cartridge (cartridge frame).

5. Remove the two small screws M2 in the front, and remove the charge roller unit 140 from the frame 20*a* (FIG. 12).

Figure 13:
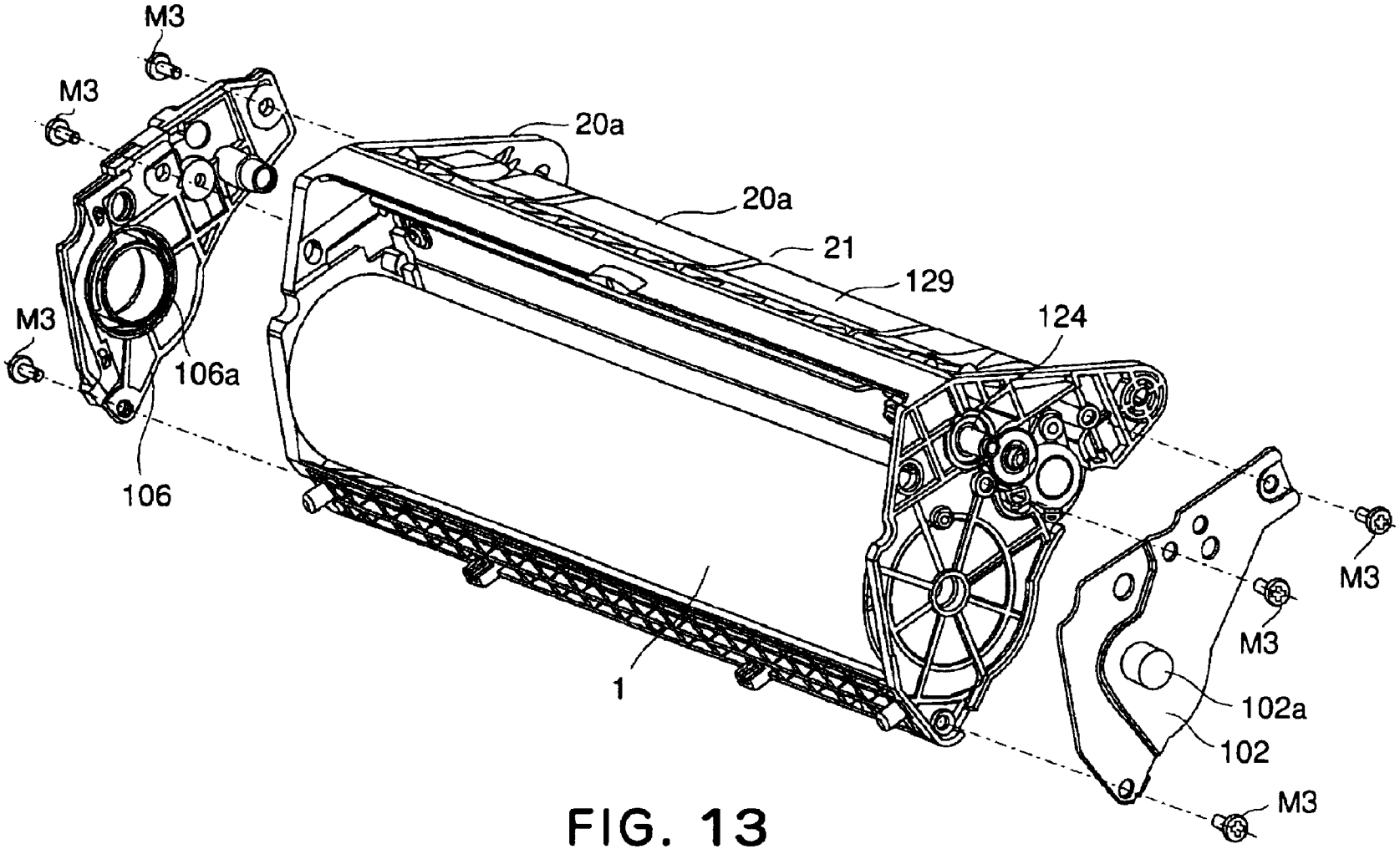
FIG. 13 is a perspective view of the process cartridge, for showing how to remove the side covers from the process cartridge (cartridge frame).

6. Remove the three small screws M4 from the lateral walls of the frame 20*a*, and then, remove the left and right drum shaft supporting members 102, and drum bearing supporting member (photoconductive member frame 129) 106 (FIG. 13).

Figure 14:
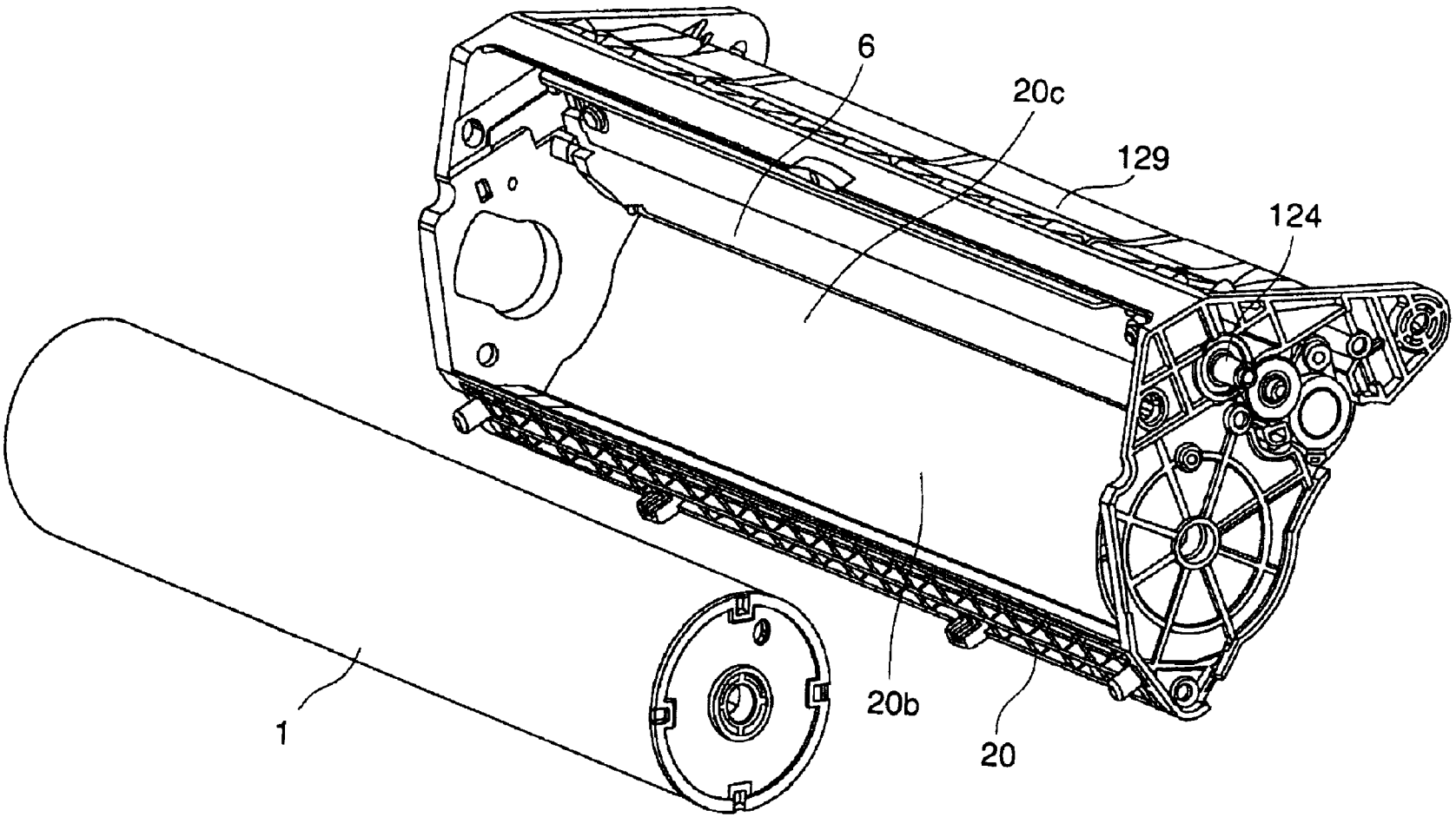
FIG. 14 is a perspective view of the process cartridge, for showing how to remove the photoconductive drum from the process cartridge (cartridge frame).

7. Remove the photoconductive member 1 from the photoconductive member unit 21; first, the right side of the drum 1 is to be pulled out frontward, and then, the entirety of the drum 1 is to be pulled out frontward (FIG. 14).

Next, the method for removing the removed developer will be described.

(2) Removal of Removed Developer (1) Extraction of Removed Developer from Photoconductive Member Unit 22

* Continuation of the above described Steps 1–7 (steps after removal of drum 1)

Figure 15:
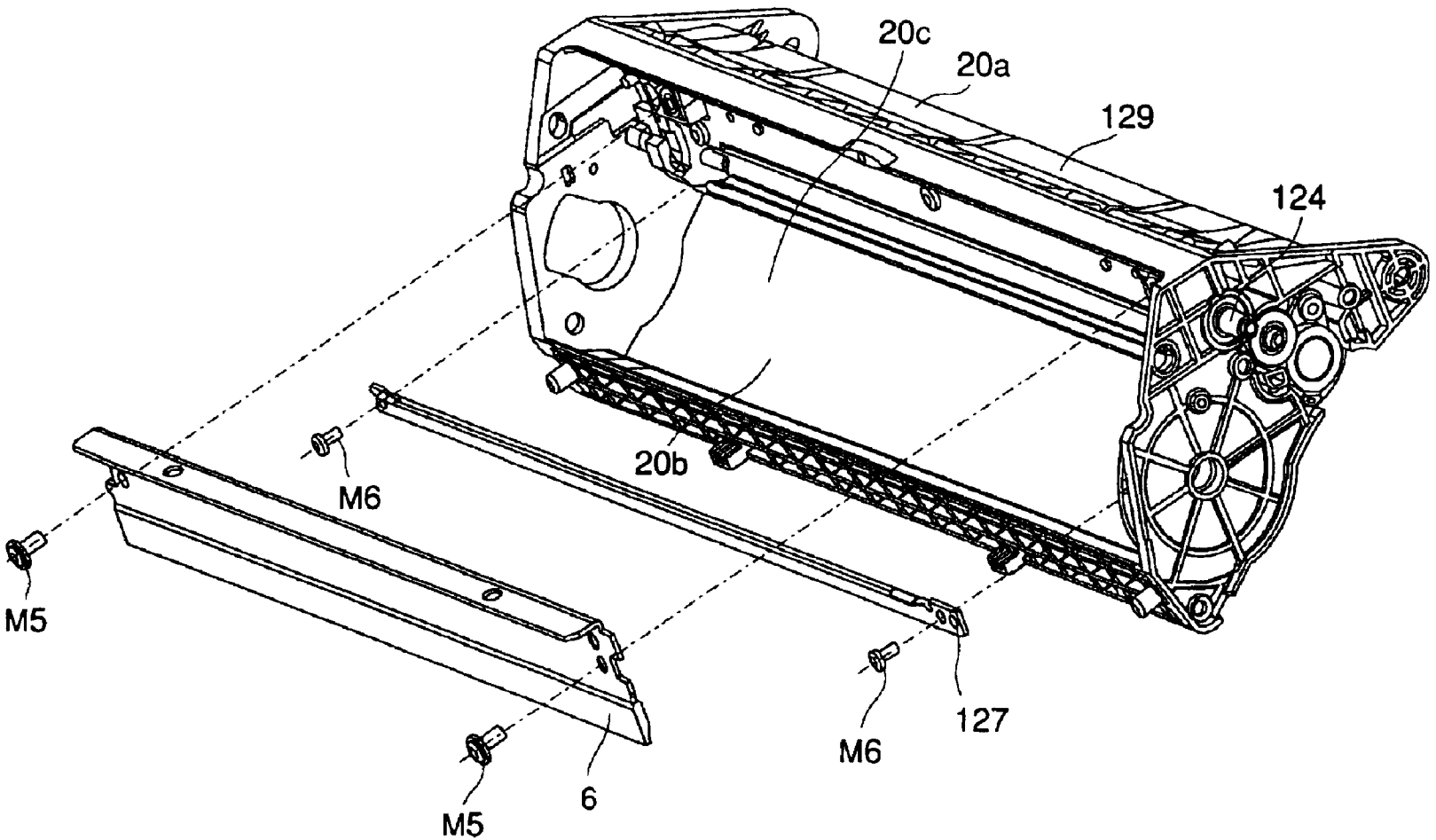
FIG. 15 is a perspective view of the process cartridge, for showing how to remove the cleaning blade and developer catching sheet from the process cartridge (cartridge frame).

8. Remove the two small screws M5 from the front wall of the frame 20*a*, and remove the cleaning blade 6 from the frame 20*a*. Further, remove the two small screws M6 from the front wall of the frame 20*a*, and remove the developer catching sheet holding metallic plate 127 from the frame 20*a* (FIG. 15).

9. Remove the sweeping blade bearing 151*a* from the left wall of the frame 20*a*, and remove the sweeping blade 151 from the frame 20*a* from the front side of the frame 20*a* (FIG. 16).

Figure 17:
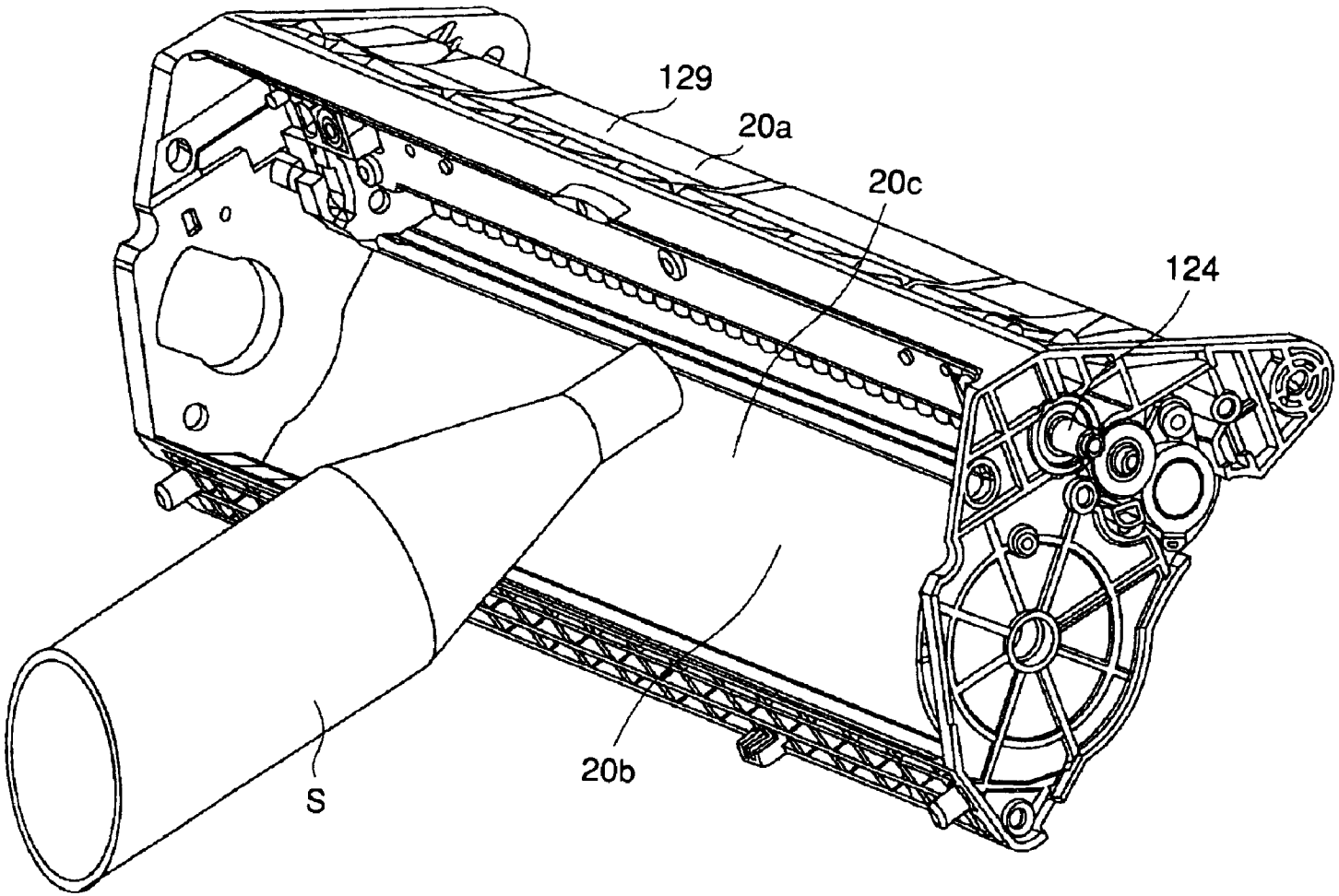
FIG. 17 is a perspective view of the process cartridge, for showing how to remove the removed developer in the process cartridge (cartridge frame).

10. Remove the removed developer having accumulated in the unit 22, with the use of a cleaner S or the like, from the front side of the unit 22 (FIG. 17).

To describe in more detail, the developer is to be removed with the use of the cleaner S, for example, a vacuum cleaner, through the opening 20*b* exposed by the removal of the various components through the above described steps.

(2) Extraction of Removed Developer from Intermediary Transfer Member Unit 22

* Continuation of Operations 1 and 2, on the intermediary transfer member unit side, after the separation of the transfer member unit 21 from the drum unit 20.

11. Remove the four small screws M7 from the right wall of the frame 20*a*, and remove the right side cover 260 and transfer member frame 245 from the frame 20*a* (FIG. 18).

12. Remove two small screws M8 from the right wall of the frame 20*a*, and pull out the screw unit 259 (in the rightward in FIG. 19). During this process, the developer leaks through the gap resulting from the removal the screw unit 259, and the leaked developer is to be removed with the use of the cleaner S or the like. The screw unit 259 is to be pulled out far enough for the screw 258 to completely come out of the transfer member unit 22 (FIG. 19).

Figure 20:
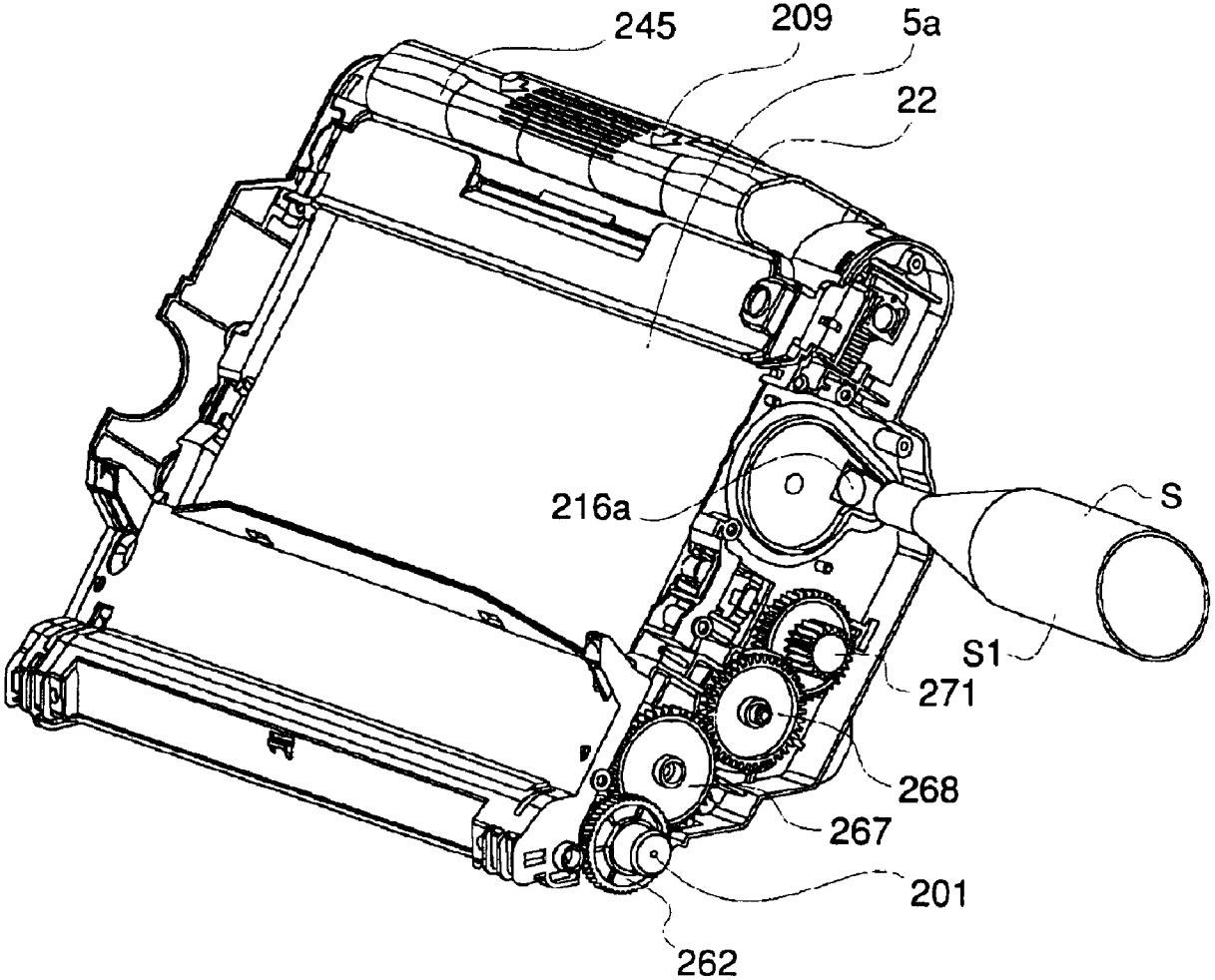
FIG. 20 is a perspective view of the process cartridge, for showing how to remove the removed developer which is in the transfer member unit.

13. Remove the developer from the removed developer storage box 216 through the hole 216*a* of the right wall of the frame 20*a*, with the use of the cleaner S or the like, while holding the transfer member unit 22 upside down, or holding it with the right wall facing downward (FIG. 20).

Incidentally, the cleaner S is schematically shown in the drawing, and the suctioning portion connected to the nozzle S1 is not shown.

The steps for attaching the components removed through the above described steps are steps opposite to the steps through which the components were removed. The components are attached with the small screws M1–M8.

Next, the method for remanufacturing the process cartridge 20 comprising the transfer member unit 22 having the above described transfer belt 5*a*, and the drum unit 21 having the electrophotographic photoconductive drum 1, will be described.

The process cartridge remanufacturing method comprises:

(i) Pin removing step for removing a pair of pins 150 and 151, which are attached to the lengthwise ends of the process cartridge 20, one for one, to keep the transfer member unit 22 and drum unit 21 joined;

(ii) Drum removing step for removing the drum unit 21 from the transfer member unit 22;

(iii) End cover removing step for removing the end cover 260 attached to one of the lengthwise ends of the transfer member unit 22;

(iv) Screw unit removing step for removing the screw unit 259 having: the screw 258 anchored to the removed developer storage portion 216 which is for storing the developer removed from the electrophotographic photoconductive drum 1; the gear 264 for transmitting the driving force to the screw 258; and entrance hole 259*a* through which the removed developer from the drum unit 21 is stored into the removed developer storage portion 216. Incidentally, in this step, the screw 258 disposed within the removed developer storage portion 216 is to be pulled out through the screw hole 216*a* of the removed developer storage portion 216, when removing the screw unit 259 from the transfer member unit frame 22*a;*

(v) Developer removing step for removing the developer in the removed developer storage portion 216, through the screw hole 216*a;*

(vi) Screw unit attaching step for inserting the screw 258 into the removed developer storage portion 216 through the screw hole 216*a*, and attaching the screw unit 259 to the transfer member unit frame 22*a;*

(vii) End cover attaching step for attaching the end cover 260 to one of the lengthwise ends of the transfer member unit 22; and (viii) Joining step for joining the transfer member unit 22 with the drum unit 21, with the pins 150 and 151.

The process cartridge remanufacturing method further comprises:

pressure applying member removing step for removing from the cartridge frame 20*a* the combination of the arm 120 and spring 123, as a pressure applying member, which is attached to one of the lengthwise ends of the process cartridge 20 to keep the drum shutter 119 pressured in the closing direction;

charge roller unit removing step for removing the charge roller unit 140, which is supporting the charge roller 2, from the cartridge frame 20*a;* drum shaft supporting member removing step for removing the drum shaft supporting member 102 integral with the drum shaft 102*a* which is attached to one of the lengthwise ends of the process cartridge 20 and is supporting one of the lengthwise ends of the electrophotographic photoconductive member 1;

drum bearing supporting member removing step for removing the drum bearing supporting member 106 attached to the other lengthwise end of the process cartridge 20 and integral with the drum bearing 106*a* which is supporting the drum shaft 1*a* (FIG. 4) attached to the other end of the electrophotographic photoconductive member 1;

drum removing step for removing the electrophotographic photoconductive member 1 from the cartridge frame 20*a;* drum inserting step for inserting a brand-new electrophotographic photoconductive member 1 into the cartridge frame 20*a;* drum shaft supporting member attaching step for attaching the drum shaft supporting member 102 integral with the drum shaft 102*a* for supporting one of the lengthwise ends of the inserted brand-new electrophotographic photoconductive member 1, to the corresponding lengthwise end of the cartridge frame 20*a*, in order to support the lengthwise end of the electrophotographic photoconductive member 1 by the corresponding lengthwise end of the cartridge frame 20*a;* drum bearing supporting member attaching step for attaching the drum bearing supporting member 106 integral with the drum bearing 106*a* for supporting the drum shaft 1*a* (FIG. 4), with which the other lengthwise end of the brand-new electrophotographic photoconductive member 1 having just been inserted into the cartridge frame 20*a* is provided, to the other lengthwise end of the cartridge frame 20*a* in order to support the other lengthwise end of the electrophotographic photoconductive member 1 by the other end of the cartridge frame 20*a;* charging unit attaching step for attaching the charge roller unit 140, which is supporting the charge roller 2, to the cartridge frame 20*a*; and pressuring means attaching step for attaching to one of the lengthwise ends of the cartridge frame 20, the combination of the arm 120 and spring 123, as a pressuring means, for keeping pressured in the closing direction, the drum shutter attached to one of the lengthwise ends of the process cartridge 20.

The process cartridge remanufacturing method further comprises:

shutter arm removing step for removing, prior to the drum shaft supporting member removing step and drum bearing supporting member removing step, the auxiliary arm 121, which is supporting the drum shutter 119, and the two ends of which are attached to the lengthwise ends of the cartridge frame 20*a*, one for one, by disengaging the two ends of the auxiliary arm 121 from the cartridge frame 20*a*; and shutter arm attaching step for attaching, after the charge unit attaching step, the two ends of the auxiliary arm 121 to the lengthwise ends of the cartridge frame 20*a*, one for one.

Further, the process cartridge remanufacturing method comprises:

cleaning blade removing step for removing the cleaning blade 6 from the cartridge frame 20*a*, after the removal of the electrophotographic photoconductive member 1 from the cartridge frame 20*a*, and before the attachment of the brand-new electrophotographic photoconductive member 1; and developer removing step for removing the developer, which has been removed from the electrophotographic photoconductive member 1 by the cleaning blade 6, through the hole of the storage portion exposed by the removal of the cleaning blade 6.

The process cartridge remanufacturing method also comprises:

guiding member removing step for removing, between the cleaning blade removing step and developer removing step, the flexible guiding member for guiding the developer, which has been removed from the electrophotographic photoconductive member 1 by the cleaning blade 6, to the hole 20*b* of the storage portion 20*c*.

In the above described process cartridge remanufacturing method, the developer adhering to the screw 258 is to be suctioned away by the suctioning device S, when the screw 258 disposed within the removed developer storage portion 216 is pulled out through the screw hole 216*a* of the removed developer storage portion 216.

According to the above described process cartridge remanufacturing method, the gears 263–266, the portion having the entrance hole 259*a*, and the screw 258, can be removed together, in the screw unit removing step, improving thereby the process cartridge remanufacture efficiency. Further, the aforementioned gears 263–266, the portion with the entrance hole 259*a*, and the screw 258, can be attached together, in the screw unit attaching step, also improving the process cartridge remanufacture efficiency. In other words, the above described process cartridge remanufacturing method simplifies the process cartridge remanufacture.

Additionally, the present invention is inclusive of all of the cases described below.

(1) The case in which a cartridge is remanufactured using only the components from a single used process cartridge.

(2) The case in which a cartridge remanufactured using only the components from a single used process cartridge like in Case (1), except that the components which cannot be reused, for example, damaged components or those the service lives of which have expired, are replaced with brand-new components or the reusable components from the other used process cartridges.

(3) The case in which removed from a plurality of used cartridges are sorted into groups of the same components, and cartridges are remanufactured by selecting the necessary components from the sorted components.

(4) The case in which various components removed from a plurality of used cartridges are sorted into groups of the same components as in Case (3), and cartridges are remanufactured by selecting the necessary components from the sorted components, except that the components which cannot be reused, for example, damaged components or those the service lives of which have expired, are replaced with brand-new components or the reusable components from the other used process cartridges.

The aforementioned components means the components, members, portions, etc., which constitute certain portions of a process cartridge. They also means the smallest units into which a process cartridge can be disassembled.

According to the above described embodiments of the present invention, a process cartridge can be simply remanufactured by removing screws or the like. Therefore, the cartridge frame or the like are not damaged during the cartridge remanufacture.

Also according to the above described embodiments, the developer in the drum unit 21 can be removed through the hole 20 of the photoconductive drum frame 129 (cartridge frame), simplifying thereby process cartridge manufacture.

Also according to the above described embodiments, the developer in the transfer member unit 22 can be removed through the screw hole 216*a* through which the force for rotationally driving the screw 258 is transmitted to the screw 258. In other words, the screw hole 216*a* can also be used for developer removal, simplifying thereby process cartridge manufacture.

As described above, the present invention simplifies process cartridge remanufacture.

While the invention has been described with reference to the structures disclosed herein, it is not confined to the details set forth, and this application is intended to cover such modifications or changes as may come within the purposes of the improvements or the scope of the following claims.

What is claimed is:

1. A remanufacturing method for remanufacturing a process cartridge including a transfer member unit having a transfer belt, and a drum unit having an electrophotographic photosensitive drum, said method comprising:

(i) a pin removing step of removing a pin which connects the transfer member unit and the drum unit at each of one and the other longitudinal ends of the process cartridge;

(ii) a drum unit removing step of removing the drum unit from the transfer member unit;

(iii) a one-end cover removing step of removing an end cover from one longitudinal end of the transfer member unit;

(iv) a screw unit removing step of removing a screw unit from a transfer member unit frame, wherein the screw unit integrally includes a screw disposed in a removed developer accommodating portion, provided in the transfer member unit, for accommodating a developer removed from the electrophotographic photosensitive drum, a gear for transmitting a rotational driving force to the screw, and an inlet opening for feeding a developer from the drum unit into the removed developer accommodating portion, and wherein when the screw unit is removed from the transfer member unit frame, the screw disposed in the removed developer accommodating portion is pulled out through an opening of the screw unit provided in the removed developer accommodating portion;

(v) a developer removing step of removing the developer accommodated in the removed developer accommodating portion through the opening of the screw unit;

(vi) a screw unit mounting step of inserting a screw into the removed developer accommodating portion through the opening of said screw unit, and mounting the screw unit to a transfer member unit frame;

(vii) a one-end cover mounting step of mounting the one-end cover to the transfer member unit; and (viii) a coupling step of coupling the transfer member unit and the drum unit by pins.

2. A method according to claim 1, further comprising:

a step of removing a charging roller unit supporting a charging roller from a cartridge frame;

a drum shaft supporting member removing step of removing a drum shaft supporting member which is integral with a drum shaft supporting one end of the electrophotographic photosensitive drum, the drum shaft supporting member being mounted at one longitudinal end of the process cartridge;

a drum removing step of removing the electrophotographic photosensitive drum from the cartridge frame;

a drum placing step of placing a fresh electrophotographic photosensitive drum in the cartridge frame;

a drum shaft supporting member mounting step of mounting, on one longitudinal end of the cartridge frame, a drum shaft supporting member which is integral with a drum shaft for supporting one end of the fresh electrophotographic photosensitive drum placed in the cartridge frame, so as to support said one end of the electrophotographic photosensitive drum on said one longitudinal end of the cartridge frame;

a drum bearing supporting member mounting step of supporting the other end of the electrophotographic photosensitive drum on the other longitudinal end of the cartridge frame by mounting, on the other longitudinal end of the cartridge frame, a drum bearing supporting member which is integral with a drum bearing for supporting a drum shaft provided at the other end of the fresh electrophotographic photosensitive drum placed in the cartridge frame;

a charging unit mounting step of mounting a charging roller unit supporting the charging roller on the cartridge frame; and an urging member mounting step of mounting, on one longitudinal end of the cartridge frame, an urging member for applying an urging force in a closing direction on a drum shutter mounted to the one longitudinal end of the process cartridge.

3. A method according to claim 2, further comprising:

a shutter arm removing step of removing, prior to said drum shaft supporting member removing step and a drum bearing supporting member removing step, one end of an auxiliary arm from one longitudinal end of the process cartridge, the auxiliary arm supporting the drum shutter and having one end which is mounted to the one longitudinal end of the cartridge frame and the other end of which is mounted to the other longitudinal end of the cartridge frame, and removing the other end of the auxiliary arm from the other longitudinal end of the process cartridge; and a shutter arm mounting step of mounting, after said charging unit mounting step, the one end of the auxiliary arm supporting the drum shutter and mounting the other end of the auxiliary arm to the other longitudinal end of the cartridge.

4. A method according to any one of claims 1–3, further comprising:

a cleaning blade removing step of removing a cleaning blade from the cartridge frame after the electrophotographic photosensitive drum is removed from the cartridge frame and before mounting the fresh electrophotographic photosensitive drum; and a developer removing step of removing the developer removed from the electrophotographic photosensitive drum by the cleaning blade, through an opening of the removed developer accommodating portion which is exposed by removing of the cleaning blade.

5. A method according to claim 4, further comprising a guiding member removing step of removing, between said cleaning blade removing step and said developer removing step, a flexible guiding member for guiding the developer removed from the electrophotographic photosensitive drum by the cleaning blade toward the opening of the removed developer accommodating portion.

6. A method according to any one of claims 1–3, wherein in said screw unit removing step, when the screw disposed in the removed developer accommodating portion is pulled out through the opening of the screw unit provision provided on the removed developer accommodating portion, the developer deposited on the screw is suctioned by a suction device.

* * * * *